US010384859B2

(12) United States Patent
Sugawara et al.

(10) Patent No.: US 10,384,859 B2
(45) Date of Patent: Aug. 20, 2019

(54) DISCHARGE CONTAINER AND METHOD OF REUSING THE SAME

(71) Applicant: DAIZO CORPORATION, Osaka-shi, Osaka (JP)

(72) Inventors: Shinya Sugawara, Kyoto (JP); Kimio Kataoka, Kyoto (JP)

(73) Assignee: DAIZO CORPORATION, Osaka (JP)

( * ) Notice: Subject to any disclaimer, the term of this patent is extended or adjusted under 35 U.S.C. 154(b) by 0 days.

(21) Appl. No.: 15/766,353

(22) PCT Filed: Oct. 6, 2016

(86) PCT No.: PCT/JP2016/079773

§ 371 (c)(1),
(2) Date: Apr. 5, 2018

(87) PCT Pub. No.: WO2017/061538

PCT Pub. Date: Apr. 13, 2017

(65) Prior Publication Data

US 2018/0312328 A1 Nov. 1, 2018

(30) Foreign Application Priority Data

Oct. 7, 2015 (JP) ..... 2015-199786

(51) Int. Cl.
*B65D 83/66* (2006.01)
*B65D 83/38* (2006.01)
*B65D 83/32* (2006.01)

(52) U.S. Cl.
CPC ..... *B65D 83/663* (2013.01); *B65D 83/38* (2013.01); *B65D 83/32* (2013.01)

(58) Field of Classification Search
CPC ..... B65D 83/663; B65D 83/66; B65D 83/44; B65D 83/16; B65D 83/38; B65D 83/32
(Continued)

(56) References Cited

U.S. PATENT DOCUMENTS 3,325,056 A * 6/1967 Lewis ..... A61K 8/02 126/263.01
3,540,623 A * 11/1970 Wittke ..... B65D 83/682 222/136
(Continued)

FOREIGN PATENT DOCUMENTS

JP S57-183978 A 11/1982
JP 558-186861 U 12/1983
(Continued)

OTHER PUBLICATIONS

Search Report issued in corresponding International Patent Application No. PCT/JP2016/079773, dated Dec. 13, 2016.

*Primary Examiner* — Lien M Ngo
(74) *Attorney, Agent, or Firm* — McDermott Will & Emery LLP

(57) ABSTRACT

Provided with a discharge container that is easy to produce and maintains a constant discharge rate per unit time from the beginning to the end. This discharge container is provided with a bottle, a valve assembly configured to close an opening of the bottle and having a valve mechanism, and a pressure regulating mechanism accommodated in the bottle and configured to regulate the internal pressure of the bottle. The pressure regulating mechanism is attached to the lower end of the valve assembly.

37 Claims, 14 Drawing Sheets

(58) Field of Classification Search
USPC ..... 222/399, 135, 402.1
See application file for complete search history.

(56) References Cited

U.S. PATENT DOCUMENTS

| | | | | | |
|---|---|---|---|---|---|
| 4,340,155 | A * | 7/1982 | Obrist | B65D 83/42 | 222/135 |
| 4,469,252 | A * | 9/1984 | Obrist | B65D 83/687 | 222/135 |
| 4,613,061 | A * | 9/1986 | Meuresch | B65D 83/687 | 222/135 |
| 6,920,904 | B2 * | 7/2005 | Yquel | B65D 83/68 | 141/20 |
| 2007/0125809 | A1 | 6/2007 | Regan et al. | | |

FOREIGN PATENT DOCUMENTS

| | | | |
|---|---|---|---|
| JP | S59-72284 | U | 5/1984 |
| JP | H11-319649 | A | 11/1999 |
| JP | 2007-519578 | A | 7/2007 |
| JP | 4050703 | B2 | 2/2008 |
| JP | 2008-526631 | A | 7/2008 |
| JP | 4364907 | B2 | 11/2009 |
| WO | 2006/091069 | A1 | 8/2006 |
| WO | WO-2010/001582 | A1 * | 1/2010 |

* cited by examiner

DISCHARGE CONTAINER AND METHOD OF REUSING THE SAME

CROSS REFERENCE

This application is the U.S. National Phase under 35 U.S.C. § 371 of International Application No. PCT/JP2016/079773, filed on Oct. 6, 2016, which claims the benefit of Japanese Application No. 2015-199786, filed on Oct. 7, 2015, the entire contents of each are hereby incorporated by reference.

TECHNICAL FIELD

The present invention relates to a discharge container and a method of reusing the discharge container.

BACKGROUND ART

In Patent Document 1, a pressure control device is disclosed in which a high-pressure container is attached to the bottom portion of a fluid dispensing container for discharging contents and when contents are discharged and the internal pressure of the fluid dispensing container drops, a pressurizing agent is replenished from the high-pressure container.

In Patent Document 2, a pressure regulating device accommodated in a pressurized discharge container and configured to regulate the internal pressure of the pressurized discharge container is disclosed.

PRIOR ART

Patent Document

Patent Document 1: Japanese Patent No. 4364907
Patent Document 2: Japanese Patent No. 4050703

SUMMARY OF THE INVENTION

Problems to be Solved by the Invention

In the pressure control device disclosed in Patent Document 1, the pressure control device is connected to the bottom portion of the fluid dispensing container. Therefore, the aerosol valve and the pressure control device should be connected to the upper end opening and the lower end opening of the fluid dispensing container, respectively. For this reason, the assembly is complicated.

In the pressure regulating device disclosed in Patent Document 2, ribs are provided in the pressure container, a high pressure cartridge filled with a pressurizing agent is fixed to the ribs, and then a valve is fixed in the pressure container. For this reason, also in this case, the assembly is complicated.

The present invention aims to provide a discharge container which is easy in production and is capable of discharging contents at a constant discharge rate from the start to the end of use. The present invention also aims to provide a method of reusing the discharge container.

Means for Solving the Problems

A discharge container according to the present invention includes a container, a valve assembly configured to close the container, the valve assembly including a valve mechanism, and a pressure regulating mechanism attached to a lower portion of the valve assembly, the pressure regulating mechanism being configured to raise internal pressure of the container to predetermined pressure when the internal pressure drops. The pressure regulating mechanism includes a cylinder portion provided below the valve assembly, a piston vertically slidably inserted in the cylinder portion to divide the cylinder portion into a pressure regulating chamber and an open chamber opened in the container, and a gas container filled with a pressurizing agent and communicated with an inside of the container in conjunction with a vertical movement of the piston. When a force received by internal pressure of the container is smaller than a force received from the pressure regulating chamber, the piston moves to open the gas container so that a capacity of the pressure regulating chamber becomes larger than a predetermined capacity to supply the pressurizing agent into the container. When the force received by the internal pressure of the container is the same or larger than the force received from the pressure regulating chamber, the piston moves to close the gas container so that the capacity of the pressure regulating chamber becomes the same or smaller than the predetermined capacity.

In the discharge container according to the present invention, it is preferable that the container and the valve assembly be detachably connected.

In the discharge container according to the present invention, it is preferable that the cylinder portion be attached to a lower portion of the valve assembly.

In the discharge container according to the present invention, it is preferable that the gas container be supported in a container. Particularly, it is preferable that the gas container be supported coaxially with the opening of the container. In the discharge container in which the gas container is supported as described above, it is preferable that the gas container be supported by the bottom portion of the container, or the pressure regulating mechanism include a container holder accommodated in the container so as to be suspended from an opening of the container, a communication hole for communicating the inside of the container holder with the inside of the container be formed in the container holder, and the gas container be supported by the container holder.

In the discharge container according to the present invention, it is preferable that the gas container be vertically movable in the cylinder portion.

In the discharge container according to the present invention, it is preferable that the cylinder portion include a holding means configured to hold the gas container.

In the discharge container according to the present invention, it is preferable that the container holder also serve as a cylinder portion.

In the discharge container according to the present invention, it is preferable that the container holder includes the cylinder portion with a bottomed cylindrical shape, a pressure regulating chamber be formed between a bottom portion of the cylinder portion and the piston, and the gas container be accommodated above the pressure regulating chamber.

A method of reusing a discharge container as recited in to any one of the above according to the present invention includes: detaching the valve assembly and the pressure regulating mechanism from the container; attaching the valve assembly and the pressure regulating mechanism to the container filled with contents; and operating the pressure regulating mechanism to fill a pressurizing agent in the container.

In the method of reusing a discharge container according to the present invention, it is preferable that an inside of the pressure regulating chamber be decompressed and then the valve assembly and the pressure regulating mechanism be detached from the container.

In the method of reusing a discharge container according to the present invention, it is preferable that after replacing the gas container, the valve assembly and the pressure regulating mechanism be attached to the container filled with contents.

In the method of reusing a discharge container according to the present invention, it is preferable that the pressure regulating mechanism be actuated in accordance with a press by the cap of the valve assembly.

Effects of the Invention

A discharge container according to the present invention includes a container, a valve assembly configured to close the container, the valve assembly including a valve mechanism, and a pressure regulating mechanism attached to a lower portion of the valve assembly, the pressure regulating mechanism being configured to raise internal pressure of the container to predetermined pressure when the internal pressure is decreased, wherein the pressure regulating mechanism includes a cylinder portion provided below the valve assembly, a piston vertically slidably inserted in the cylinder portion to divide the cylinder portion into a pressure regulating chamber and an open chamber opened in the container, a gas container filled with a pressurizing agent and communicated with an inside of the container in conjunction with a vertical movement of the piston, when a force received by internal pressure of the container is smaller than a force received from the pressure regulating chamber, the piston moves to open the gas container so that a capacity of the pressure regulating chamber becomes larger than a predetermined capacity to supply the pressurizing agent into the container, and when the force received by the internal pressure of the container is the same or larger than a force received from the pressure regulating chamber, the piston moves to close the gas container so that a capacity of the pressure regulating chamber becomes the same or smaller than the predetermined capacity. Therefore, by simply assembling it, the pressurizing agent in the gas container will be automatically filled in the container and it becomes ready for ejection. Further, the pressure regulating mechanism is attached to the lower portion of the valve assembly, and therefore the assembly can be performed easily. And it is not required to directly fill the pressurizing agent in the container. Also, since the pressure regulating mechanism is constructed by the piston for compressing the pressure regulating chamber, it is easy to control the internal pressure when the pressure regulating mechanism operates by the volume of the pressure regulating chamber and the cross-sectional area of the piston. For example, by controlling the internal pressure of the discharge container within the range of 0.1 to 0.3 MPa (gauge pressure), the load on the container 11 can be reduced. Therefore, the container 11 can be made thin to reduce the amount of raw material used, which makes it possible to provide a product with a small environmental burden. In that case, when recycling the container, the container can be crushed by hand to reduce the volume of the container, which in turn can enhance the collection efficiency.

In the discharge container according to the present invention, in cases where the container and the valve assembly are detachably attached by screw threads or the like, the assembly of the discharge container can be performed even by a user. That is, when the concentrate runs out, the user removes the valve assembly and the pressure regulating mechanism and puts them in a new container filled with a concentrate, resulting in a state in which it is ready to eject the concentrate. Therefore, it is possible to reuse parts, such as, a valve assembly, a pressure regulating mechanism, and a discharge member.

In the discharge container according to the present invention, in cases where the cylindrical portion is attached to the lower portion of the valve assembly, the pressure regulating mechanism can be easily inserted into the container, and the assembly can be performed more easily.

In the discharge container according to the present invention, in cases where the gas container is supported in the container, when attaching the valve assembly to which the pressure regulating mechanism is attached, the piston can be supported via the container. Therefore, it is possible to stably and reliably form a pressure regulating chamber at predetermined internal pressure. Also, after the production, the gas container is less likely to move in the container. In particular, by arranging the gas container coaxially with the opening of the container, the assembly process (operation) is greatly simplified.

In the case of supporting the gas container on the bottom portion of the container, the structure can be simplified, and therefore the productivity is high and the production cost can be lowered.

In cases where the pressure regulating mechanism is provided with a container holder accommodated in the container so as to be suspended from the opening of the container, the communication hole is formed in the container holder to communicate the inside of the container holder with the inside of the container and the gas container is supported by the container holder, the gas container can be more reliably supported.

In the discharge container according to the present invention, in cases where the gas container can move up and down in the cylinder portion, it can be mounted or taken out without operating the gas container at the time of the production step or disassemble step.

In the discharge container according to the present invention, in cases where the cylinder portion is provided with the holding means for holding the gas container, the cylinder portion and the gas container can be integrated to assemble the discharge container and the gas container can be taken out by taking out the cylinder portion. Therefore, the production and disassembly can be performed easily.

In the discharge container according to the present invention, in cases where the container holder also serves as a cylinder portion, the production and the disassembly can be more simplified.

In the discharge container according to the present invention, in cases where the container holder includes the cylinder portion with a bottomed cylindrical shape, the pressure regulating chamber is formed between the bottom portion of the cylinder portion and the piston, and the gas container is accommodated above the pressure regulating chamber, the gas container and the contents are less likely to come into contact each other, and the contents and the gas container are less susceptible to mutual influence and stabilized. Furthermore, when removing the container holder from the valve assembly, the pressure of the pressure regulating chamber pushes up the gas container, which facilitates the replacement.

The method of reusing a discharge container as recited in any one of the above includes a step of detaching the valve assembly and the pressure regulating mechanism from the container, a step of attaching the valve assembly and the pressure regulating mechanism to the container filled with contents, and a step of operating the pressure regulating mechanism to fill a pressurizing agent in the container. Therefore, most of the discharge container can be reused.

In the method of reusing a discharge container according to the present invention, by depressurizing the pressure regulating chamber and then removing the valve assembly and the pressure regulating mechanism from the container, the aerosol container can be taken out without ejecting the entire pressurizing agent, and therefore the aerosol container can be reused.

In the method of reusing a discharge container according to the present invention, by replacing the gas container and then attaching the valve assembly and the pressure regulating mechanism to the container filled with contents, the contents can be stably discharged even after the reuse.

In the method of reusing a discharge container according to the present invention, by actuating the pressure regulating mechanism in accordance with a press of the cap of the valve assembly, even a user can easily fill a pressurizing agent.

EMBODIMENTS FOR CARRYING OUT THE INVENTION

Figure 1:
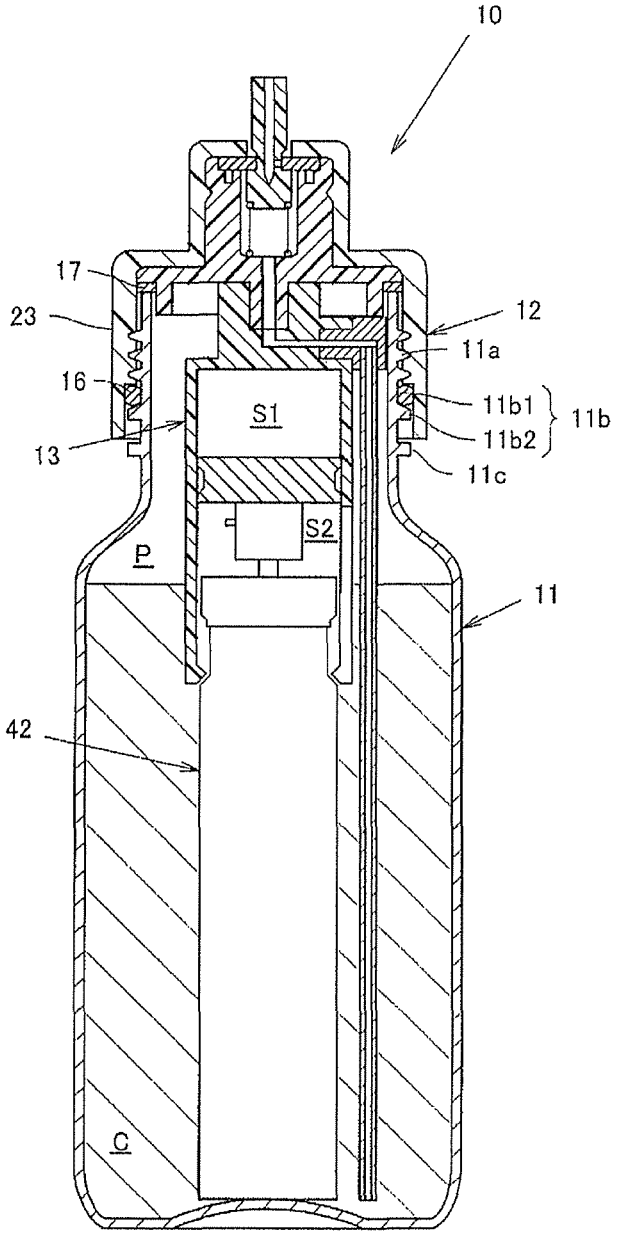
FIG. 1 is a cross-sectional view showing one embodiment of a discharge container according to the present invention.

The discharge container 10 shown in FIG. 1 is provided with a bottle (container) 11, a valve assembly 12 configured to close the opening of the bottle 11 and having a valve mechanism, and a pressure regulating mechanism 13 accommodated in the bottle 11 and configured to regulate the internal pressure of the bottle 11. The pressure regulating mechanism 13 is attached to the lower portion of the valve assembly 12.

Contents C and a pressurizing agent P are filled in the bottle 11 of the discharge container 10 to serve as a discharge product.

The bottle 11 is a bottomed cylindrical synthetic resin bottle provided with a cylindrical body portion, a tapered shoulder portion, and a cylindrical neck portion.

On the outer periphery of the neck portion, screw threads 11*a* configured to be screw-engaged with a cap 23 of the valve assembly 12 are formed. Note that the engaging means is not always limited to the screw threads but may be any other engaging means capable of being engaged with the cap 23. Below the screw threads 11*a* (engaging means), a cylindrical seal holding portion 11*b* composed of an outer cylindrical portion 11*b*1 and an annular projection 11*b*2 formed at the lower end of the outer cylindrical portion is formed. An annular sealing material 16 having a circular cross-section is held in the seal holding portion 11*b*. This sealing material 16 seals the space between the bottle 11 and the cap 23 of the valve assembly 12. The outer cylindrical portion 11*b*1 is a portion which comes into close contact with the inner surface of the sealing material 16, and the annular step portion 11*b*2 is a portion which prevents the sealing material 16 from coming out of the outer cylindrical portion 11*b*1. Further, below the seal holding portion 11*b*, an annular step portion 11*c* for holding the bottle 11 at the time of assembling the discharge container 10 and for hanging the bottle 11 at the time of filling contents C is formed. The outer shape of the annular step portion 11*c* is not limited to a circular shape but may have a flat surface provided in part or may be formed into a rectangular shape or a polygonal shape for the purpose of preventing rotation of the discharge container 10.

As the material of the bottle 11, polyethylene terephthalate (hereinafter referred to as "PET"), polyethylene (hereinafter referred to as "PE"), polypropylene (hereinafter referred to as "PP"), polyamide (hereinafter referred to as "PA") or the like is used. In particular, "PET" is preferably used from the viewpoint of easy blow molding and excellent heat resistance, and "PA" is preferably used from the viewpoint of alkali resistance.

The bottle 11 is preferably configured such that, after the use, in a state in which nothing is filled therein (in a state in which the gauge pressure is zero (0)), a general user can crush by hand. For example, the thickness of the thinnest portion (the body portion in this embodiment) of the bottle 11 is 0.1 to 0.5 mm, preferably 0.15 to 0.4 mm. If the thickness is larger than 0.5 mm, the strength is high and therefore it cannot be crushed by hand. In addition, the amount of the synthetic resin to be used increases, which is likely to increase the load on the environment and increases the cost. If the thickness is less than 0.1 mm, the strength is too weak, causing a risk of rupturing of the bottle when, e.g., dropped.

On the inner surface of the bottle 11, a vapor deposited film may be provided. As the vapor deposited film, a film formed by coating carbon, aluminum oxide, silica, etc., in a gaseous state under a reduced pressure to coat the surface (inner surface) may be exemplified. In view of the facts that the penetration preventing effect of the pressurizing agent, such as, e.g., nitrogen and carbon dioxide, is high and that contents can be stably stored, a carbon film (DLC film) may be preferably used.

Further, the bottle 11 may be transparent or translucent so that the interior can be visually recognized.

Figure 2A:
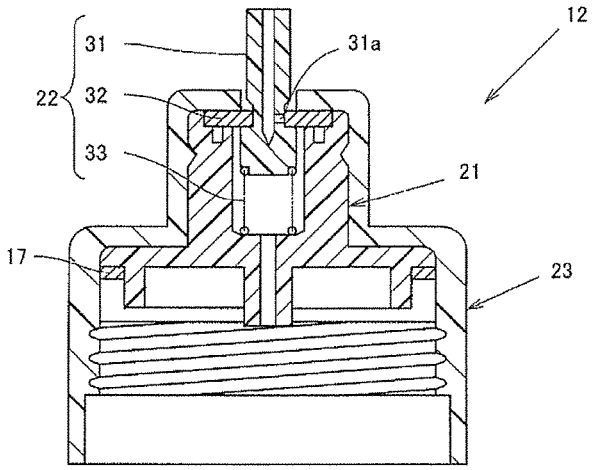
FIG. 2A, FIG. 2B, and FIG. 2C are a cross-sectional view of a valve assembly, a cross-sectional view of a valve holder, and a cross-sectional view of a cap of the discharge container shown in FIG. 1, respectively.

As shown in FIG. 2A, the valve assembly 12 is provided with a valve holder 21 for closing the bottle 11, a valve mechanism 22 accommodated in the valve holder 21 and configured to communicate/isolate the bottle 11 with/from the outside air, and a cap 23 configured to be fixed to the bottle 11 in a manner as to cover the valve holder 21.

Figure 2B:
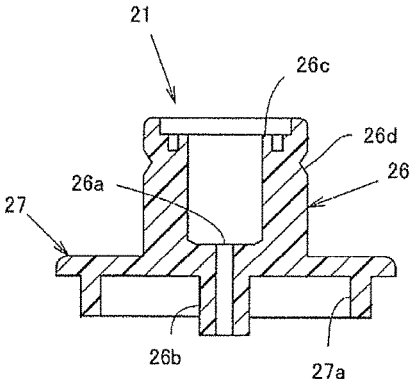

As shown in FIG. 2B, the valve holder 21 is provided with a cylindrical housing 26 and a flange portion 27 extending outward from a side surface of the housing.

The housing 26 is a cylindrical body with an opened upper end, and is provided with a communication hole 26*a* formed at the lower end of the cylindrical body to communicate the inside of the housing with the inside of the bottle. In this embodiment, at the lower end of the housing 26, a downwardly protruded connecting cylinder 26*b* to be connected to a pressure regulating mechanism which will be described later is provide. At the upper end of the housing 26, a rubber support portion 26*c* for supporting the stem rubber 32 of the valve mechanism 22 is formed. An annular recess 26*d* is formed on the upper outer peripheral surface of the housing 26.

The flange portion 27 is arranged at the upper portion of the bottle 11 (see FIG. 1). Between the flange portion 27 and the upper end of the bottle 11, an annular gasket 17 is provided. On the lower surface of the flange portion 27, a cylindrical seal holding wall 27*a* configured to be inserted into the bottle 11 to support the gasket 17 is formed coaxially with the housing 26.

Returning to FIG. 2A, the valve mechanism 22 is an aerosol type valve composed of a cylindrical stem 31, the stem rubber 32 for closing the stem hole 31*a* of the stem 31, and a spring 33 constantly urging the stem 31 upward. By lowering the stem 31, the inside of the housing 26 comes into communication with the outside air.

Figure 2C:
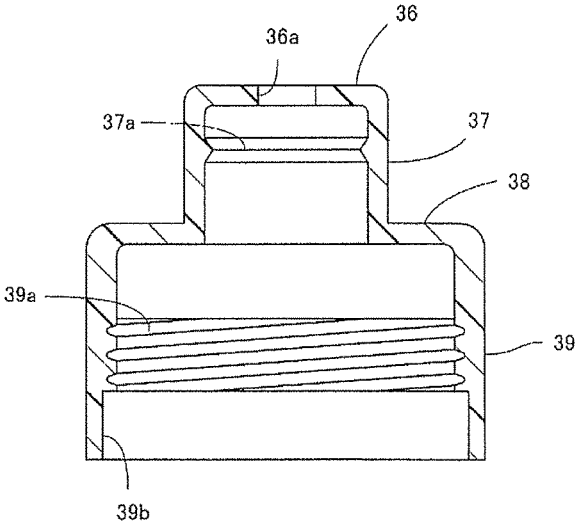

As shown in FIG. 2C, the cap 23 fixes the valve mechanism 22 to the housing 26 of the valve holder 21 and detachably fixes the valve holder 21 to the bottle 11 in a manner as to cover the valve holder 21. In detail, the cap 23 includes a disk-shaped cover portion 36 for closing the opening of the housing 26 of the valve holder 21, an upper cylindrical portion 37 extending downward from the edge of the cover portion 36 and configured to be arranged on the outer periphery of the housing 26, an annular ring portion 38 extending radially outward from the lower end of the upper cylindrical portion 37, and a lower cylindrical portion 39 extending downward from the outer end of the ring portion 38.

The cover portion 36 prevents the stem rubber 32 from jumping out upward. In the center of the cover portion 36, a center hole 36*a* through which the stem 31 passes is formed.

The upper cylindrical portion 37 is a portion for holding the housing 26 of the valve holder 21. On the inner surface of the upper cylindrical portion 37, an engaging protrusion 37*a* to be engaged with the annular recess 26*d* of the housing 26 is formed. By holding the valve holder 21 (housing 26) by the cover portion 36 and the engaging protrusion 37*a*, the valve mechanism 22 is fixed to the valve holder 21 (housing 26) and the valve holder 21 is held (see FIG. 2A). That is, the cap 23 and the valve holder 21 can be integrated.

The ring portion 38 is a portion that covers the upper surface of the flange portion 27 of the valve holder 21 so that the valve holder 21 is not pulled out of the bottle 11 (see FIG. 2A).

The lower cylindrical portion 39 is a portion to be engaged with the bottle 11. Screw threads 39*a* to be engaged with screw threads 11*a* of the bottle 11 are formed on the inner surface of the lower cylindrical portion 39. At the lower inner surface below the screw threads 39*a* of the lower cylindrical portion 39 which corresponds to the position of the seal holding portion 11*b* of the bottle 11, an inner cylindrical portion 39*b* slightly larger in diameter than the annular step portion 11*b*2 is formed. This inner cylindrical portion 39*b* is a portion for compressing the sealing material 16 in a radial direction between this inner cylindrical portion 39*b* and the outer cylindrical portion 11*b*1 of the bottle 11 (see FIG. 1). In this embodiment, screw threads are used as a means for fixing the bottle and the valve assembly, but the structure is not particularly limited as long as the bottle and the valve assembly can be detachably attached with each other. Also note that it is not always required that the bottle and the valve assembly are detachably attached.

Figure 3A:
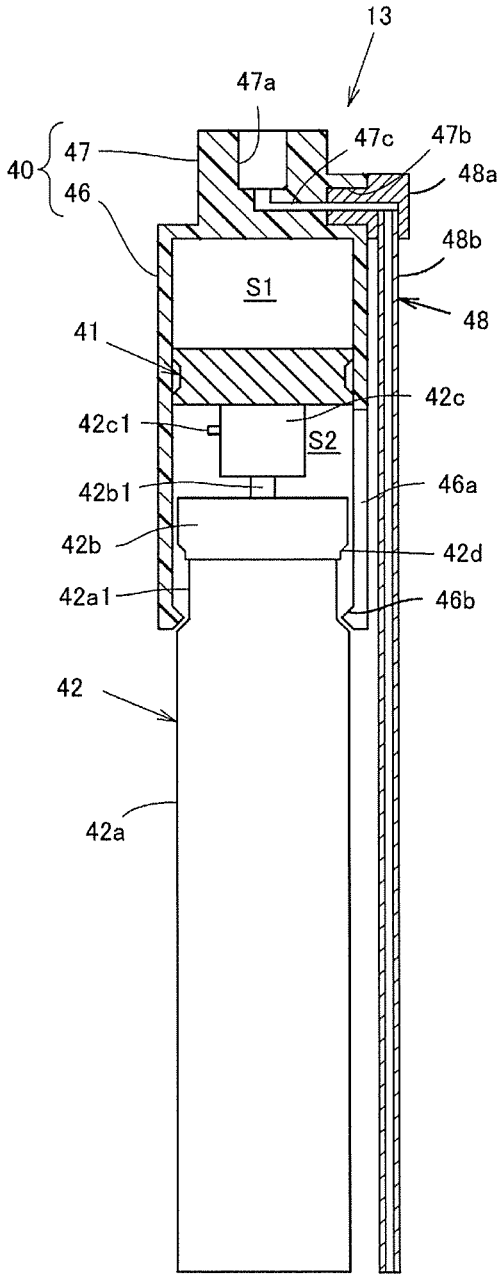
FIG. 3A and FIG. 3B are cross-sectional views showing a state before and a state after activation of a pressure regulating mechanism of the discharge container shown in FIG. 1, respectively.

As shown in FIG. 3A, the pressure regulating mechanism 13 is provided with a cylinder member 40 to be engaged with the connecting cylinder 26*b* of the housing 26, a piston 41 to be accommodated in the cylinder member 40, and an aerosol container (gas container) 42 filled with a pressurizing agent and configured to be inserted into the lower end of the cylinder member 40.

The cylinder member 40 is provided with a cylinder portion 46 having a lower open end, a connecting portion 47 provided at the upper end of the cylinder portion, and a concentrate introduction member 48 attached to the connecting portion 47.

The cylinder portion 46 is provided below the valve assembly 12 via the connecting portion 47. A piston 41 is vertically slidably inserted into the cylinder portion 46. At the lower portion of the cylinder portion 46, a slit 46*a* extending upward from the lower end is formed. Further, at the lower end of the cylinder portion 46, a holding claw 46*b* protruding radially inward is formed. The holding claw 46*b* is configured to hold the piston 41 so as not to drop down when it is accommodated in the cylinder portion 46 and also hold the gas container 42, which will be described later, so as not to move in the lateral direction. That is, the holding claw 46*b* functions as a holding means of the cylinder portion. The shape of the holding means is not particularly limited as long as a part of the cylindrical portion is engaged with a part of the gas container 42, and the gas container can be held.

The connecting portion 47 is provided with a first connecting hole 47*a* for inserting the connecting cylinder 26*b* of the housing 26, a second connecting hole 47*b* for connecting a concentrate introduction member 48 which will be described later, and a communication passage 47*c* which communicates the communication hole 26*a* (first connecting hole 47*a*) of the housing 26 with the concentrate introduction member 48 (second connecting hole 47*b*).

The concentrate introduction member 48 is composed of an adapter 48*a* attached to the second connecting hole 47*b* of the connecting portion 47 and a tube 48*b* attached to the adapter 48*a*, and is configured to communicate the communication passage 47*c* with the vicinity of the lower end (concentrate phase) of the bottle 11. Note that it is sufficient that the lower end of the tube 48*b* is immersed in the concentrate phase. Also note that the concentrate introduction member 48 is unnecessary when used upside down.

The piston 41 moves up and down while closely contacting with the inner surface of the cylinder portion 46. That is, the piston 41 divides the inside of the cylinder portion 46 into a sealed upper space S1 (pressure regulating chamber) and a lower space S2 (open chamber) opened to the inside of the bottle. Therefore, the piston 41 moves up and down in the cylinder portion 46 to compress and expand the upper space (pressure regulating chamber). When the inside of the pressure regulating chamber S1 is compressed, the air therein is compressed, so that the piston 41 receives a reaction force. However, an elastic body, such as, a spring, may be inserted into the upper space S1. In that case, it is not required to seal the upper space S1. In place of the piston, a pressure position conversion device, such as, e.g., a diaphragm, may be used.

The aerosol container 42 is configured to move up and down in the cylinder portion 46 of the cylinder member 40 and is provided with a cylinder engaging portion which engages with the holding claw 46*b* so that the aerosol container 42 does not come out of the cylinder portion 46. Specifically, the aerosol container 42 is composed of a pressure-resistant container 42*a*, an aerosol valve 42*b* for closing the opening of the pressure-resistant container, and a push button 42*c* attached to the stem 42*b*1 of the aerosol valve 42*b*. The pressure-resistant container 42*a* includes a body portion, a tapered shoulder portion, and a neck portion 42*a*1 smaller in diameter than that of the body portion. The aerosol valve 42*b* is attached to the opening which is provided at the upper part of the neck portion and larger in diameter than the neck portion. When the aerosol container 42 moves up and down, the holding claw 46*b* is arranged at the neck portion. However, the body portion may be reduced in diameter to thereby omit the shoulder portion and the neck portion.

The aerosol container 42 is fixed to the cylinder portion 46 by engaging the holding claw 46*b* of the cylinder portion 46 with the lower end (cylinder engaging portion) 42*d* of the aerosol valve 42*b*. The aerosol valve 42*b* is larger in diameter than the neck portion 42*a*1. The holding claw 46*b* is configured to move back and forth between the lower portion of the aerosol valve 42*b* and the upper portion of the shoulder portion. Therefore, the aerosol container 42 is held in a manner as to move up and down in the cylinder portion. However, it may be configured such that the holding claw 46*b* is not provided and the aerosol container 42 is supported by the inner surface of the cylinder portion 46.

As the pressurizing agent P filled in the pressure-resistant container 42*a*, for example, a compressed gas, such as, compressed nitrogen, compressed carbon dioxide gas, and compressed air, can be exemplified. The internal pressure of the aerosol container 42 is preferably 0.5 to 7 MPa (gauge pressure). In particular, it is preferable to pressurize the container to 0.6 to 1 MPa (gauge pressure). Then, the content is preferably 5 to 50 ml, particularly 10 to 30 ml. The piston 41 is arranged on the push button 42*c*. When the piston 41 pushes down the push button 42*c* to lower the stem 42*b*1, the aerosol valve 42*b* is opened, so that the pressurizing agent P in the pressure-resistant container 42*a* is ejected from the discharge port 42*c*1 of the push button 42*c*. When the stem 42*b*1 of the aerosol valve 42*b* and the piston 41 are configured so as to be interlocked with each other, it is not always necessary to provide the push button 42*c*.

The aerosol container 42 is configured to be placed on the bottom portion of the bottle 11 coaxially with the opening of the bottle (see FIG. 1). At that time, the holding claw 46*b* of the cylinder portion 46 is positioned at the neck portion 42*a*1 of the pressure-resistant container 42*a*. When the aerosol container 42 is brought into contact with the bottom portion of the bottle 11 coaxially with the opening of the bottle 11, the bottle 11, the valve assembly 12, and the pressure regulating mechanism 13 can all be arranged coaxially, so that the pressure regulating chamber S1 can be formed while supporting the aerosol container 42 at the bottom portion of the bottle 11. Therefore, as will be described later, by simply fixing the valve assembly 12 to the bottle 11, the discharge container 10 can be assembled. For this reason, the assembly can be easily performed even by a user.

Figure 3B:
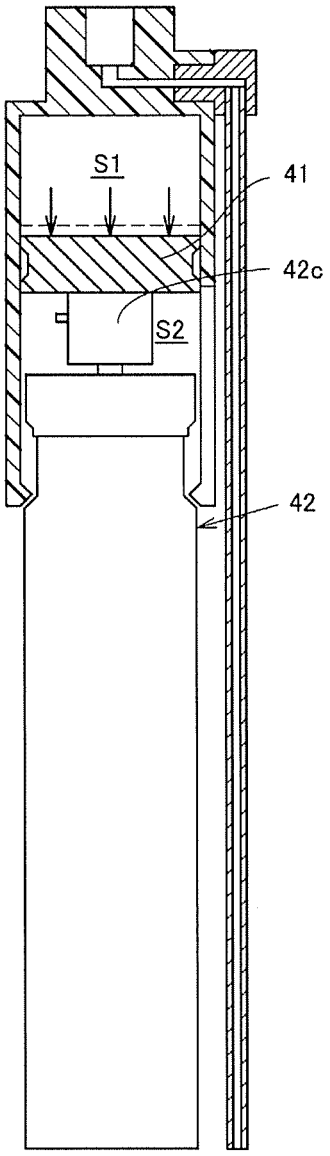

The pressure regulating mechanism 13 configured as described above operates by the difference between the pressure of the upper space (pressure regulating chamber) S1 and the internal pressure of the bottle 11. Specifically, as shown in FIG. 3B, when the pressure of the upper space S1 becomes larger than the pressure of the bottle 11 (lower space S2), the piston 41 moves so that the upper space S1 expands, that is, the piston 41 moves downward. At this time, the internal pressure of the upper space S1 decreases. Therefore, the push button 42*c* of the aerosol container 42 is pushed down, so that the pressurizing agent P is supplied from the aerosol container 42 into the bottle 11. When the pressurizing agent P is sufficiently supplied into the bottle 11 and the pressure of the upper space S1 and the pressure of the bottle 11 become substantially the same, due to the spring force (restoring force) of the aerosol valve 42*b*, the piston 41 moves to the original position so that the upper space S1 contracts, that is, the piston 41 rises. Therefore, the push button 42*c* of the aerosol container 42 returns and the aerosol valve 42*b* is also shut off.

The pressure at which the pressure regulating mechanism operates can be adjusted by the pressure and/or the volume in the pressure regulating chamber S1, the cross-sectional area of the piston, the spring in the aerosol valve, the aforementioned spring, etc. For example, it is preferable that the gauge pressure of the discharge container 10 be adjusted to 0.1 to 0.3 MPa, particularly 0.12 to 0.25 MPa. In other words, it is preferable that the pressure regulating mechanism operate when the internal pressure of the bottle 11 after discharging the concentrate reaches pressure lower than the internal pressure.

Next, a method of assembling the discharge container 10 will be described.

First, as shown in FIG. 2A, the cap 23 is fixed to the valve holder 21 accommodating the valve mechanism 22 to form the valve assembly 12. On the other hand, as shown in FIG. 3, the cylinder member 40 accommodating the piston 41 is attached to the gas container filled with the pressurizing agent to form the pressure regulating mechanism 13. Then, the cylinder member 40 is connected to the connecting cylinder 26*b* of the valve holder 21 to prepare a lid member in which the valve assembly 12 and the pressure regulating mechanism 13 are integrated (see FIG. 4A). At this time, since the upper end of the slit 46*a* of the cylinder portion 46 is located above the piston 41, the upper space S1 is not hermetically sealed.

Figure 4A:
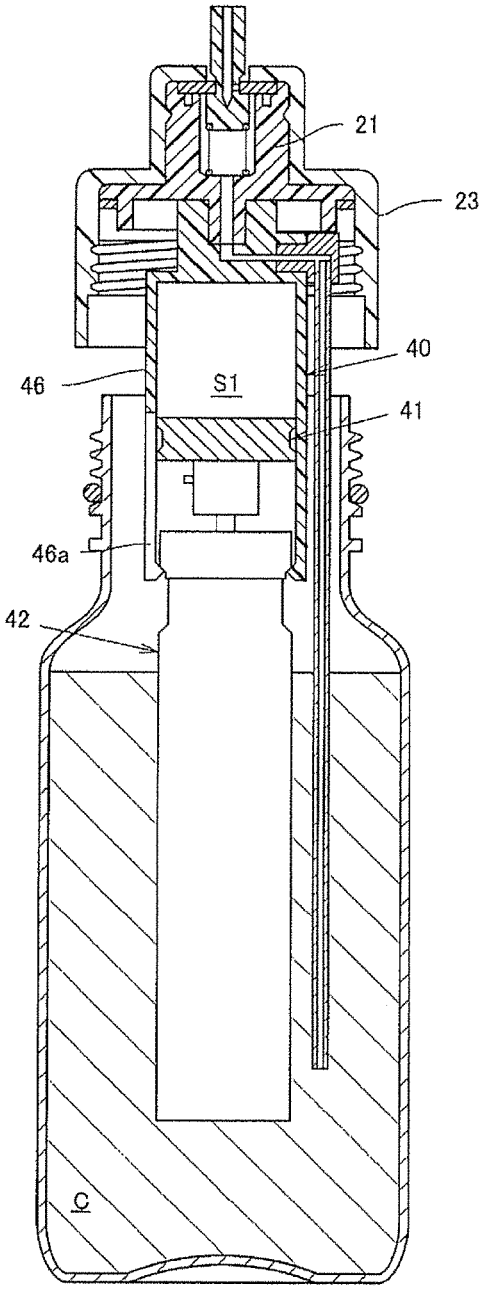
FIG. 4A and FIG. 4B are schematic diagrams showing assembly steps of the discharge container shown in FIG. 1.
Figure 4B:
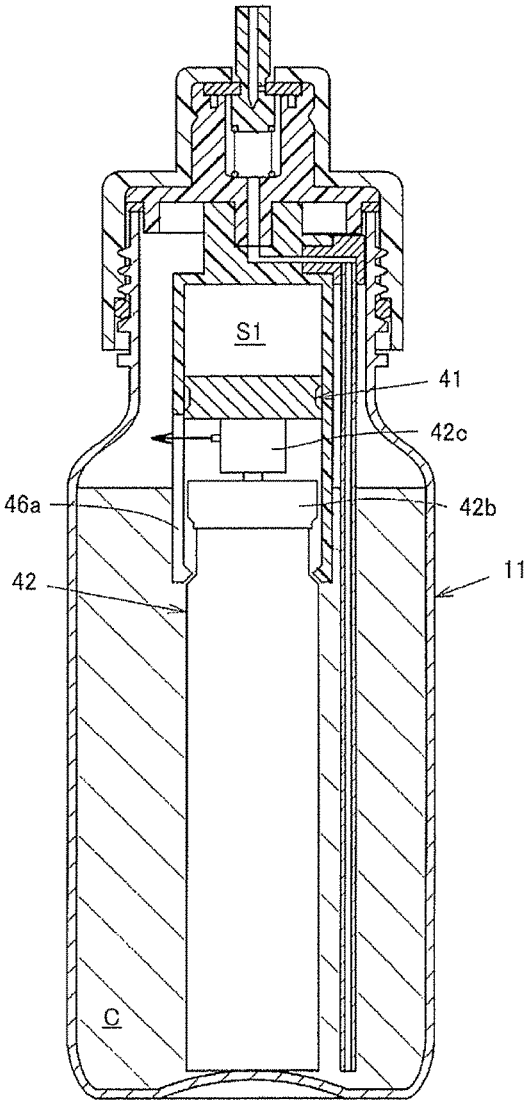

This lid member is fixed to the bottle 11 filled with contents C. At this time, the bottom portion of the aerosol container 42 is placed on the bottom portion of the bottle 11. Next, the aerosol container 42 moves upward in the cylinder portion 46. Next, the push button 42*c* pushes up the piston 41, so that the pressure regulating chamber S1 is sealed and compressed. When the pressure in the pressure regulating chamber S1 becomes larger than the elastic force of the spring of the aerosol valve, as shown in FIG. 4B, the push button 42*c* is pushed down, so that the aerosol valve 42*b* is opened. As a result, the pressurizing agent P is ejected from the push button 42*c* of the aerosol container 42 and supplied into the bottle 11 via the slit 46*a* of the cylinder portion 46. When the inside of the bottle 11 reaches predetermined pressure, the piston 41 is pushed up to the height where the aerosol valve 42*b* is closed. As a result, the pressure of the upper space (pressure regulating chamber) S1 and the pressure inside the bottle 11 are substantially balanced and the ejection of the aerosol container 42 stops (see FIG. 1).

As described above, in the discharge container 10, the pressurizing agent P can be filled in the bottle 11 just by the assembly, which eliminates the use of special equipment for filling a pressurizing agent. Further, after assembling the discharge container 10, the internal pressure of the bottle 11 can be controlled to be constant as will be described later. The pressure can be lowered than the conventional discharge product (aerosol product), and the bottle can be thinned.

Since the discharge container 10 can be assembled by a user himself/herself by using a lid member in which the valve assembly 12 and the pressure regulating mechanism 13 are integrated, a replacement product sealed by a lid cover may be combined with a bottle 11 filled with contents C. With this, the valve assembly 12, etc., can be reused. It is also possible to exchange only the aerosol container 42.

Figure 5A:
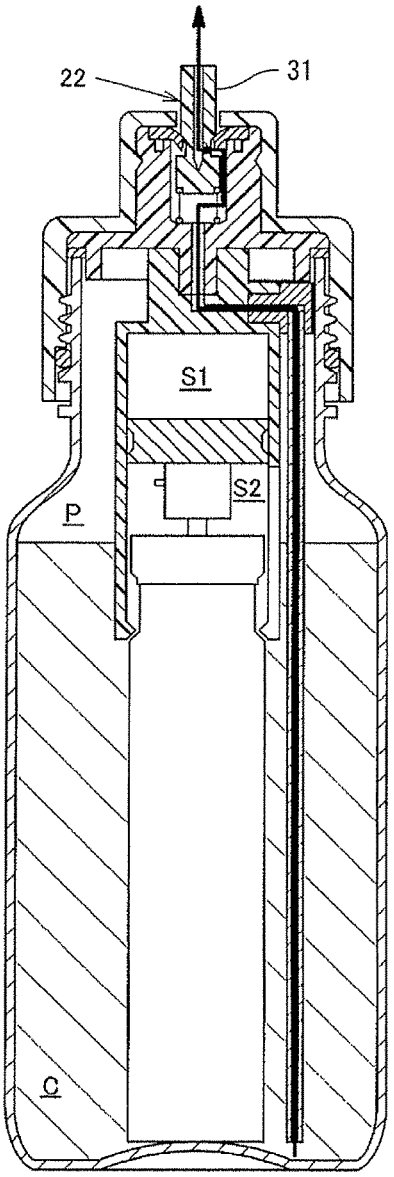
FIG. 5A and FIG. 5B are schematic diagrams each showing the use state of the discharge container shown in FIG. 1.
Figure 5B:
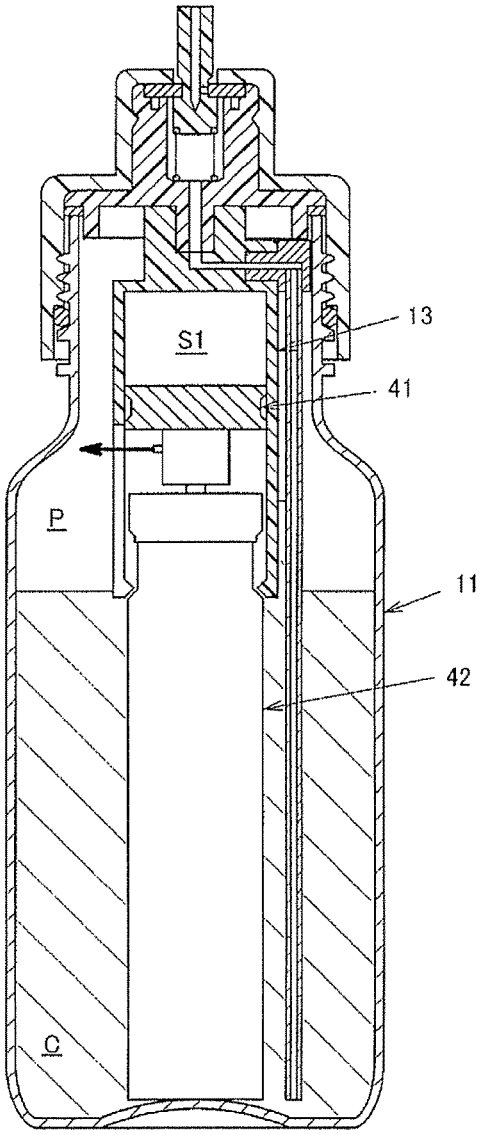

Next, a use method of the discharge product will be described. The use method is as follows. As shown in FIG. 5A, the stem 31 is pushed down with a push button (not shown) or the like to release the valve mechanism 22. As a result, contents C can be discharged by the pressure of the pressurizing agent P in the bottle 11. By discharging the contents C, when the volume of the gas phase increases and therefore the internal pressure of the bottle 11 decreases, the pressure regulating mechanism 13 automatically operates as shown in FIG. 5B. As a result, the pressurizing agent P is fed into the bottle 11 from the aerosol container 42 and the supply of the pressurizing agent P is automatically stopped when the pressure in the bottle 11 is balanced with the pressure regulating chamber S1. Since the supply process and the supply stop process of this pressurizing agent P are performed automatically each time the contents C is discharged, the contents C can be discharged at the same momentum to the end.

After discharging the entire contents C, the bottle 11 and the lid member (the valve assembly 12 and the pressure regulating mechanism 13) can be separated by rotating the cap 23.

At this time, the valve assembly 12 and the cylinder member 40 initially move upward with the piston 41 and the aerosol container 42 remained unmoved. When the lower end (cylinder engaging portion) of the aerosol valve 42*b* of the aerosol container 42 is engaged with the holding claw 46*b* of the cylinder portion 46, the piston 41 and the aerosol container 42 also move upward together with the valve assembly 12, etc. That is, as shown in FIG. 4A, it is in a state in which the aerosol container 42 is attached to the cylinder portion 46, that is, the holding claw 46*b* is engaged with the lower portion 42*d* of the aerosol valve and the piston 41 is positioned below the upper end of the slit 46*a* of the cylinder portion 46. With this configuration, the upper space S1 can be opened to the bottle 11 (outside air) via the slit 46*a*. Therefore, it is possible to disassemble without ejecting the entire pressurizing agent in the aerosol container 42. Then, the aerosol container 42 retained by the holding claw 46*b* can be taken out of the bottle 11. In this case, since the aerosol container 42 can be taken out without ejecting the entire pressurizing agent, the aerosol container 42 can be reused. Note that even when the holding claw 46*b* is not provided to the cylinder portion 46, the aerosol container 42 can be reused. In the case of not providing the holding claw 46*b*, the assembly is performed by inserting the aerosol container 42 in the bottle 11 and attaching the lid member (except for the aerosol container 42) to the bottle 11.

Figure 6:
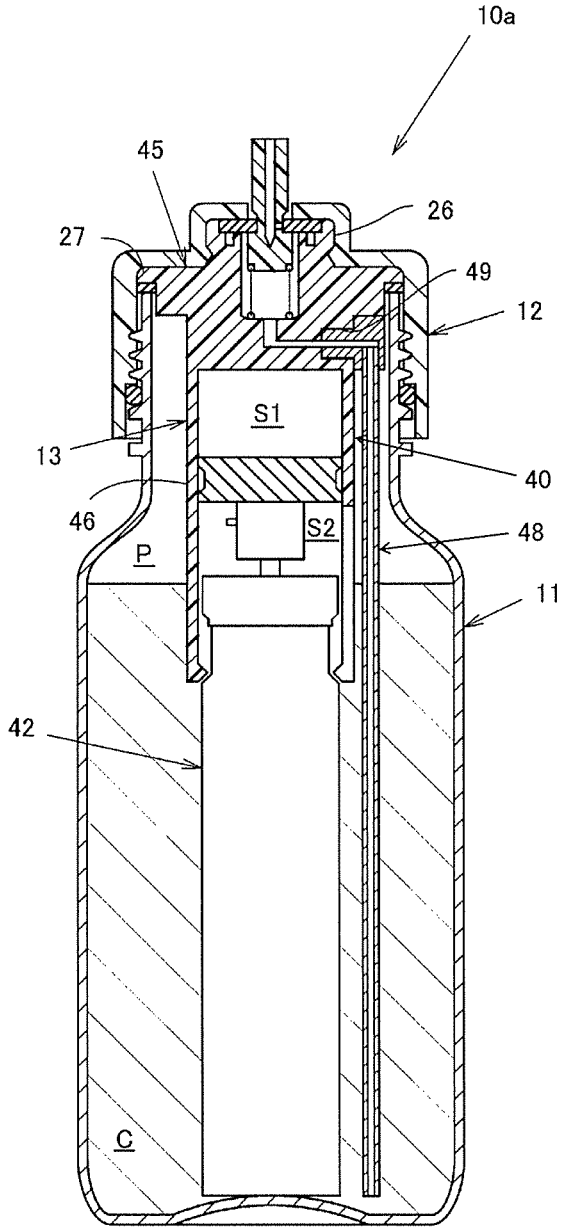
FIG. 6 is a cross-sectional view showing another embodiment of a discharge container according to the present invention.

In the discharge container 10*a* shown in FIG. 6, the housing 26 and the cylinder member 40 of the valve assembly 12 are integrally formed. In detail, the discharge container is provided with a valve holder 45 including a housing 26, a flange portion 27, a cylinder portion 46, and an introduction member connecting portion 49. The introduction member connecting portion 49 is a connecting hole for accepting a concentrate introduction member 48. The housing 26, the flange portion 27, and the cylinder portion 46 are substantially the same as those of the discharge container 10 shown in FIG. 1. Other configurations are substantially the same as those of the discharge container 10 shown in FIG. 1.

Figure 7:
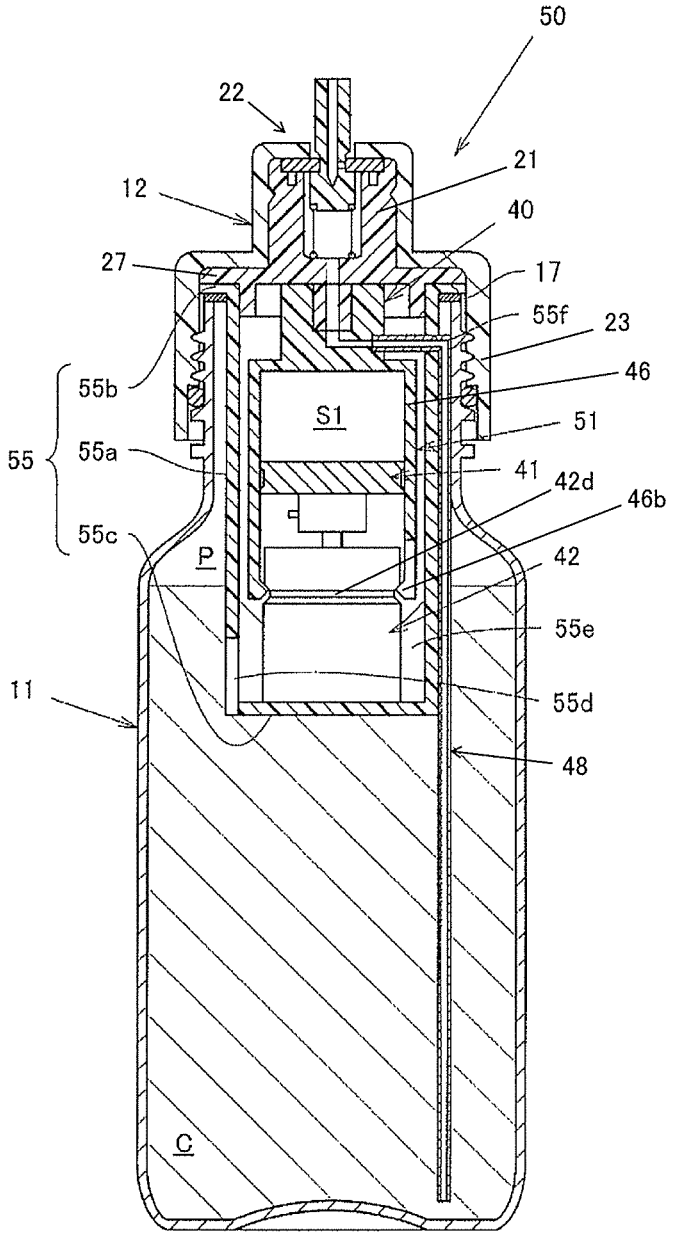
FIG. 7 is a cross-sectional view showing still another embodiment of a discharge container according to the present invention.

The discharge container 50 shown in FIG. 7 is provided with a container holder 55 to be suspended from the opening of the bottle 11, and an aerosol container 42 is supported by the container holder 55. In detail, the discharge container is provided with a bottle 11, a valve assembly 12 for closing the bottle 11, and a pressure regulating mechanism 51 accommodated in the bottle 11 to adjust the internal pressure of the bottle 11. The pressure regulating mechanism 51 is attached to the lower end of the valve assembly 12. The bottle 11 and the valve assembly 12 are substantially the same as those of the discharge container 10 shown in FIG. 1.

The pressure regulating mechanism 51 is provided with a cylinder member 40, a piston 41 accommodated in the cylinder member 40, an aerosol container (gas container) 42 filled with a pressurizing agent and inserted at the lower end of the cylinder portion 46, and a container holder 55 suspended from the opening of the bottle. The cylinder member 40 and the piston 41 are substantially the same as those of the discharge container shown in FIG. 1. The aerosol container 42 is also substantially the same as the aerosol container 42 of the discharge container 10 shown in FIG. 1 except that it is shorter than the aerosol container 42 of the discharge container 10.

The container holder 55 stabilizes the position of the aerosol container 42 when attaching the valve assembly 12 to the bottle 11 to thereby facilitate the engagement of the aerosol container with the cylinder portion 46 and also holds the aerosol container 42 even after the attachment of the valve assembly 12 to thereby facilitate the operation of the piston 41 and the push button. In detail, the container holder is composed of a cylindrical holder body 55*a*, a flange portion 55*b* formed at the upper end of the cylindrical holder body, and a bottom portion 55*c* closing the lower end of the cylindrical holder body. At the lower portion of the holder body 55*a*, there is formed a slit 55*d* which communicates between the holder body 55*a* and the bottle 11. On the lower inner surface of the holder body 55*a*, positioning ribs 55*e* for positioning the aerosol container 42 are formed in a radially arranged manner. Further, at the upper portion of the holder body 55*a*, an insertion hole 55*f* for fitting a concentrate introduction member 48 is formed. In the container holder 55, the flange portion 55*b* is clamped and held by and between the upper end of the bottle 11 and the flange portion 27 of the valve holder 21 of the valve assembly 12. The lower surface of the flange portion 55*b* is a portion for downwardly compressing the annular plate sealing material 17 downward.

In the same manner as the pressure regulating mechanism 13 of the discharge container shown in FIG. 1, the pressure regulating mechanism 51 is also operated by the pressure difference between the pressure of the upper space (pressure regulating chamber) S1 and the pressure of the bottle 11. Since the aerosol container 42 is placed on the container holder 55, the aerosol container 42 can be reliably supported. This causes no fear that the aerosol container 42 will be displaced during and after the production.

A method of assembling the discharge container 50 will be described below.

First, the container holder 55 accommodating the aerosol container 42 is accommodated in the bottle 11 filled with contents C. On the other hand, a lid member is prepared in which the cap 23 is fixed to the valve holder 21 accommodating the valve mechanism 22 to assemble the valve assembly 12 and the cylinder member 40 in which a piston 41 is inserted is attached to the connecting cylinder 26*b* of the valve holder 21. When this lid member is fixed to the bottle 11, the aerosol container 42 is held in the cylinder portion 46. As a result, the pressure regulating mechanism 51 is activated, so that the pressurizing agent is ejected from the aerosol container 42 to pressurize the inside of the bottle 11 to predetermined pressure. Thus, the discharge container 50 can be assembled. In this case, the push button 42*c* of the aerosol container 42 and the piston 41 are brought into contact with each other immediately before attaching the bottle 11 to the lid member. Therefore, there is no need to make the aerosol container 42 movable up and down within the cylinder portion 46. On the other hand, since the aerosol container 42 is supported by the container holder 55, engagement with the holding claw 46*b* and formation of the pressure regulating chamber S1 can be performed stably. However, also in this case, it is not required to provide the holding claw 46*b*.

Figure 8:
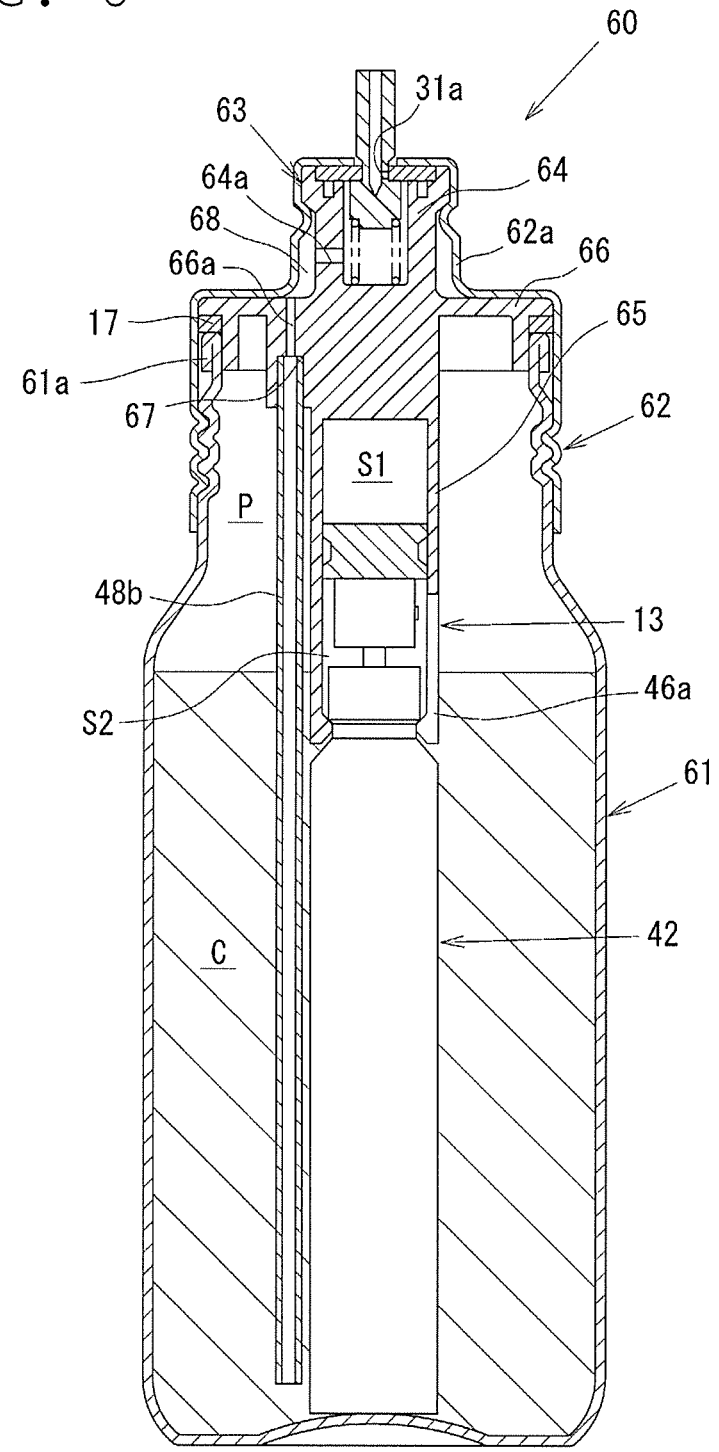
FIG. 8 is a cross-sectional view showing still yet another embodiment of a discharge container according to the present invention.

In the discharge container 60 shown in FIG. 8, the container 61 and the cap 62 are made of metal, specifically made of aluminum, and a rolled portion 61*a* is provided at the opening to prevent scratching of the gasket 17 when the cap 62 is screwed. By using the metal container 61, permeation of oxygen and transmission of light can be blocked and the contents C can be stably stored. The valve holder 63 is integrally provided with a housing portion 64 accommodating a valve mechanism, a cylinder portion 65 forming a pressure regulating mechanism 13, a flange portion 66 which sandwiches the gasket 17 by and between this flange portion and the upper end of the rolled portion 61*a* of the container 61, and an introduction member connecting portion (tube insertion portion) 67 for connecting the tube 48*b*.

At the upper end of the tube insertion portion 67, a through-hole 66*a* vertically penetrating the valve holder 63 is provided, and the tube 48*b* inserted into the tube insertion portion 67 is communicated with the through-hole 66*a*. Above the through-hole 66*a*, there is a cylindrical space 68 provided between the inner peripheral surface of the upper cylindrical portion 62*a* of the cap 62 and the outer peripheral surface of the housing portion 64. In the side wall of the housing portion 64, a lateral hole 64*a* communicating with the inside of the housing portion 64 is formed. Therefore, the contents C filled in the container 61 passes through the tube 48*b*, the through-hole 66*a*, the cylindrical space 68, the lateral hole 64*a*, enters the housing portion 64, and is discharged to the outside (discharge member) from the stem hole 31*a*.

The pressure regulating mechanism 13 is provided in the same manner as in the previously described discharge containers 10 and 10*a*, and therefore it is possible to adjust the pressure inside the container to the range of 0.1 to 0.3 MPa (gauge pressure). For this reason, it is possible to suppress the thickness of the container 61 to, for example, 0.05 to 0.3 mm, preferably 0.1 to 0.25 mm (about ⅓ to ⅔ of the normal thickness), which makes it possible to crush by hand after removing the valve assembly.

Figure 9:
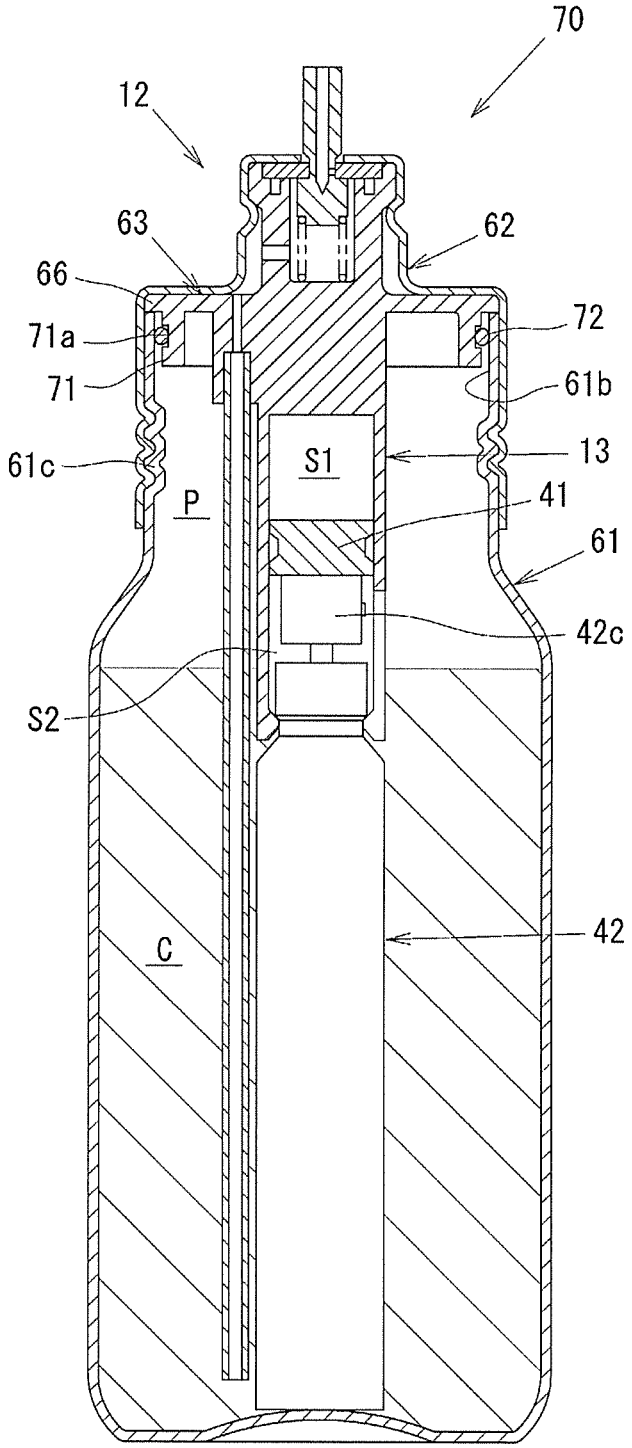
FIG. 9 is a cross-sectional view showing still yet another embodiment of a discharge container according to the present invention.

In the discharge container 70 shown in FIG. 9, at a position distant downward from the flange portion 66 on the outer peripheral surface side of the annular wall 71 of the valve holder 63, a concave groove 71*a* is formed, and an O-ring 72 having a circular cross-section is held in the concave groove 71*a*. A sealing point is formed between the inner peripheral surface of the neck portion of the container 61 and the annular wall 71 of the valve holder 63. Specifically, by compressing the O-ring 72 in the horizontal direction between the inner peripheral surface of the neck portion (cylindrical portion) 61*b* of the container 61 which is formed as a straight and flat surface in the vertical direction and the bottom portion of the concave groove 71*a* of the valve holder 63, sealing is performed between the container 61 and the valve holder 63.

With such a seal, before the gas container 42 is pressed against the bottom of the container 61 or before the push button 42*c* of the gas container 42 is pushed by the piston 41 (before the pressure regulating mechanism 13 operates), the O-ring 72 is brought into contact with the inner peripheral surface of the cylindrical portion 61*b* to form a seal. Thus, it is possible to suppress leakage of the pressurizing agent P. Further, in cases where the distance from the O-ring 72 to the lower surface of the flange portion 66 is shorter than the screw thread length, when the cap 62 is loosened by being rotated in a detaching direction, the seal is released before the screw threads 61*c* are disengaged. Therefore, the pressurizing agent P remaining in the container 61 can be discharged, which can prevent the valve assembly 12 from being pulled out of the container. Other configurations are substantially the same as those of the discharge container shown in FIG. 8.

Figure 10:
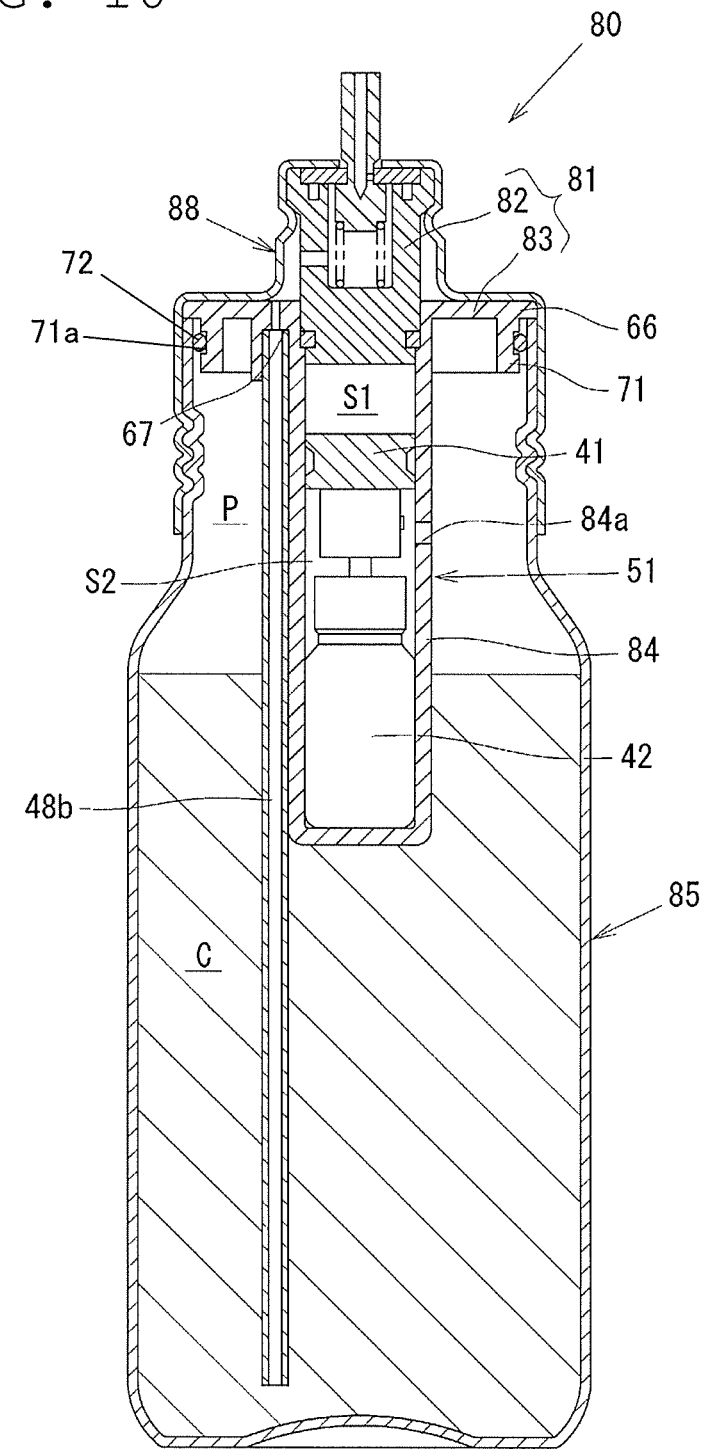
FIG. 10 is a cross-sectional view showing still yet another embodiment of a discharge container according to the present invention.

In the discharge container 80 shown in FIG. 10, the valve holder 81 shown in FIGS. 8 and 9 is separated into the housing 82 and the other portion (container holder) 83.

The container holder 83 is provided with a cylinder portion 84 forming a pressure regulating mechanism 51, a flange portion 66 positioned at the upper end of the neck portion of the container 85, a concave groove 71*a* for holding an O-ring 72 having a circular cross-section at a position distant downward from the flange portion 66 on the outer peripheral surface side of the annular wall 71, and a tube insertion portion 67 for connecting the tube 48*b*. Unlike the discharge containers 60 and 70 shown in FIGS. 8 and 9, the cylinder portion 84 is formed in a bottomed tubular shape with a closed lower end. For this reason, the gas container 42 can be supported in a manner as to be suspended from the opening of the container 85. This state can be said that the cylinder portion 84 also serves as a container holder.

The aforementioned discharge container 80 is assembled as follows. First, the gas container 42 is accommodated in the container holder 83. Next, the piston 41 is placed in the container holder 83 to form an open chamber S2 between the piston 41 and the bottom portion of the cylinder portion 84. This open chamber S2 is communicated with the inside of the container 85 via the communication hole 84*a* provided in the side wall of the cylinder portion 84. After that, the annular wall 71 of the container holder 83 is inserted into the opening of the container 85 to seal with the O-ring 72. Subsequently, the lower portion of the housing 82 is attached to the upper end opening of the cylinder portion 84 of the container holder 83. Then, the cap 88 is screwed into the container 85. As a result, the housing 82 is pushed downward, and a seal is formed between the outer peripheral surface of the housing 82 and the inner peripheral surface of the cylinder portion 84. A pressure regulating chamber S1 is formed between the lower surface of the housing 82 and the upper surface of the piston 41. With this, the pressurizing agent in the gas container 42 is supplied from the open chamber S2 into the container 85, completing the assembly.

In the discharge container 80 configured as described above, since the housing 82 and the container holder 83 are formed separately, by simply removing the cap 88 after the use to remove the housing 82 from the container holder 83, it becomes possible to access the gas container 42. Thus, the gas container 42 can be easily removed. When the cap 88 is loosened, the pressure inside the container 85 drops. However, at the same time the pressure regulating chamber S1 is opened to the outside. Therefore, even in cases where the pressurizing agent P remains in the gas container 42, it is possible to suppress additional ejection of the pressurizing agent P. Therefore, the gas container 42 can be removed in a state in which the pressurizing agent P remains. Since the gas container 42 is covered with the cylinder portion 84 and is not exposed to the contents C, hands will not get dirty during the removal. Also, it is unnecessary to apply a corrosion prevention coating on the surface of the gas container 42. In order to suppress entry of contents C into the cylinder portion 84, the communication hole 84*a*, which only allows communication with the inside of the container 85, may be blocked by a material (e.g., nonwoven fabric, open-cell sponge, etc.) which is breathable but poor in liquid permeability, or may be provided with a check valve. Other configurations are substantially the same as those of the discharge container 70 shown in FIG. 9.

Figure 11:
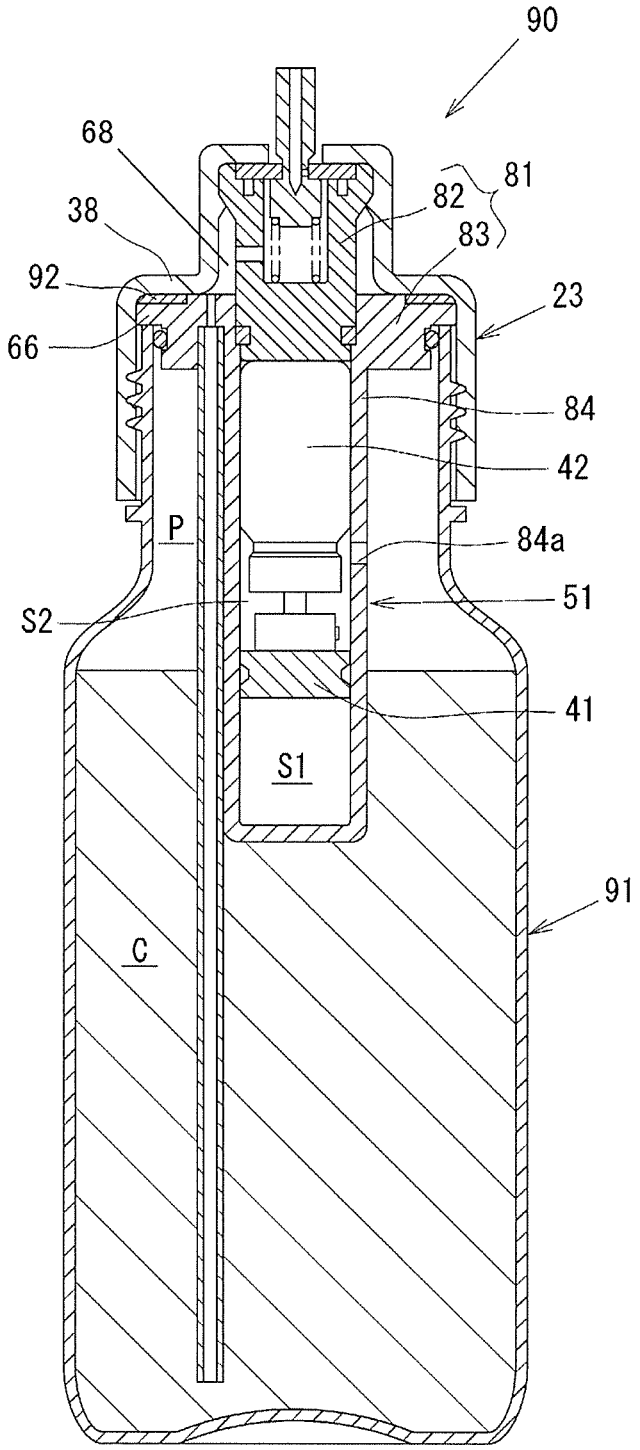
FIG. 11 is a cross-sectional view showing still yet another embodiment of a discharge container according to the present invention.

In the discharge container 90 shown in FIG. 11, the gas container 42 is accommodated in the cylinder portion 84 in the inverted state, the piston 41 is positioned below the gas container 42, and the pressure regulating chamber S1 is provided on the bottom portion side of the cylinder portion 84. With such a configuration, when the cap is loosened for the purpose of replacing the gas container 42, the gas container 42 will be lifted by the pressure in the pressure regulating chamber S1, which facilitates the removal of the gas container. Further, it is not required to remove the piston 41, which further simplifies the replacement work. In this discharge container 90, a synthetic resin bottle 91 and a cap 23 are used. For this reason, a sealing material 92 is provided between the lower surface of the ring portion 38 of the cap 23 and the upper surface of the flange portion 66 of the container holder 83 to suppress the leakage of contents C from the cylindrical space 68. Note that a metal container and a cap may be used. Also note that the gas container 42 may be accommodated in the cylinder portion 84 in the upright state. Other configurations are substantially the same as those of the discharge container 80 shown in FIG. 10.

Figure 12:
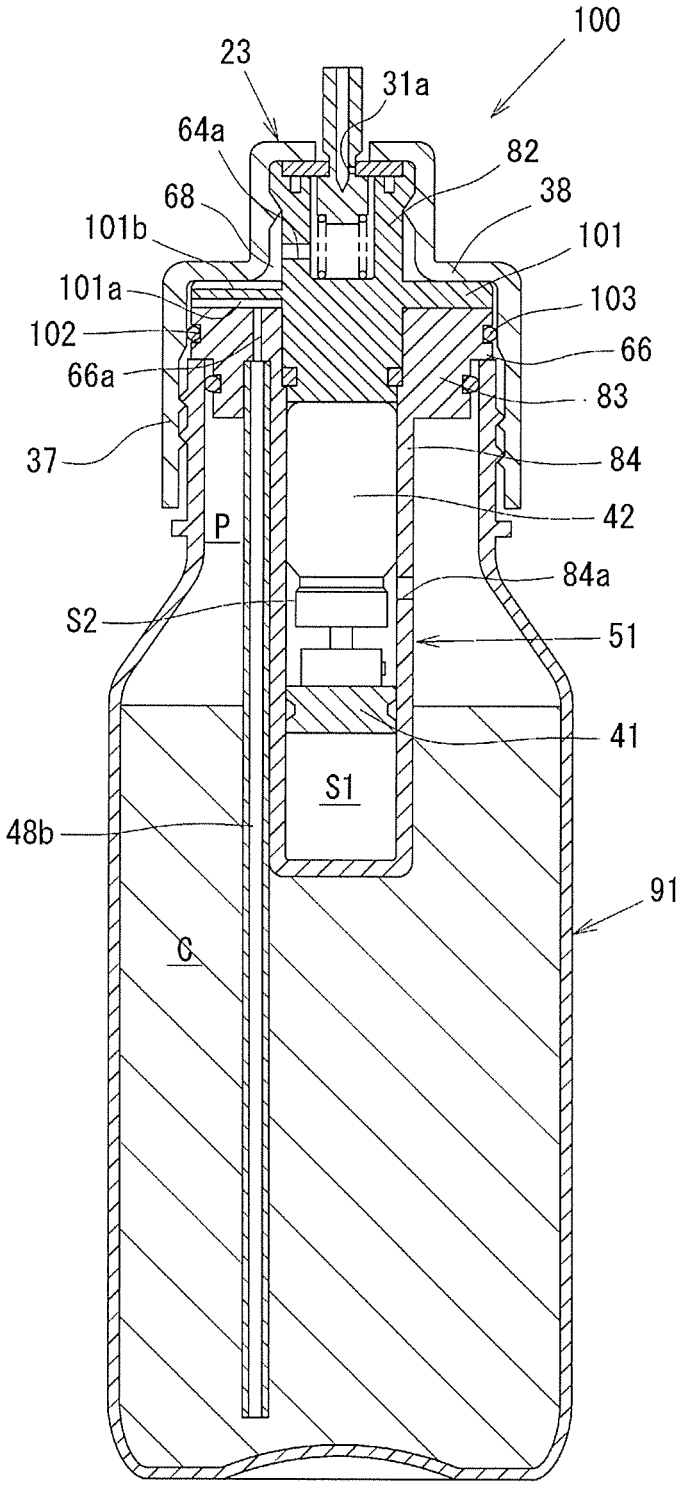
FIG. 12 is a cross-sectional view showing still yet another embodiment of a discharge container according to the present invention.

In the discharge container 100 shown in FIG. 12, the housing 82 is provided with a flange portion 101 extending outward. In such a discharge container 100, an excessive press of the housing 82 into the cylinder portion 84 is restricted by the flange portion 101, and therefore the accuracy of pressure adjustment is improved.

Since the flange portion 101 is positioned above the through-hole 66*a* communicated with the tube 48*b*, grooves 101*a* and 101*b* are formed on the upper and lower surfaces of the flange portion 101, respectively. The contents C enter to the inside of the housing 82 via the tube 48*b*, the through-hole 66*a*, the lateral passage formed by the upper surface of the flange portion 66 of the container holder 83 and the groove 101*a* on the lower surface side of the flange portion 101 of the housing 82, a lateral passage formed by the groove 101*b* on the upper surface side of the flange portion 101 and the lower surface of the ring portion 38 of the cap 23, the cylindrical space 68, and the lateral hole 64*a*, and is discharged to the outside (discharge member) from the stem hole 31*a*.

In this embodiment, a concave groove 102 is formed on the side surface of the container holder 83, and an O-ring 103 is provided therein, so that a seal is formed between the inner surface of the lower cylindrical portion 39 of the cap 23 and the bottom surface of the concave groove 102 of the container holder 83. Other configurations are substantially the same as those of the discharge container shown in FIG. 11.

Figure 13:
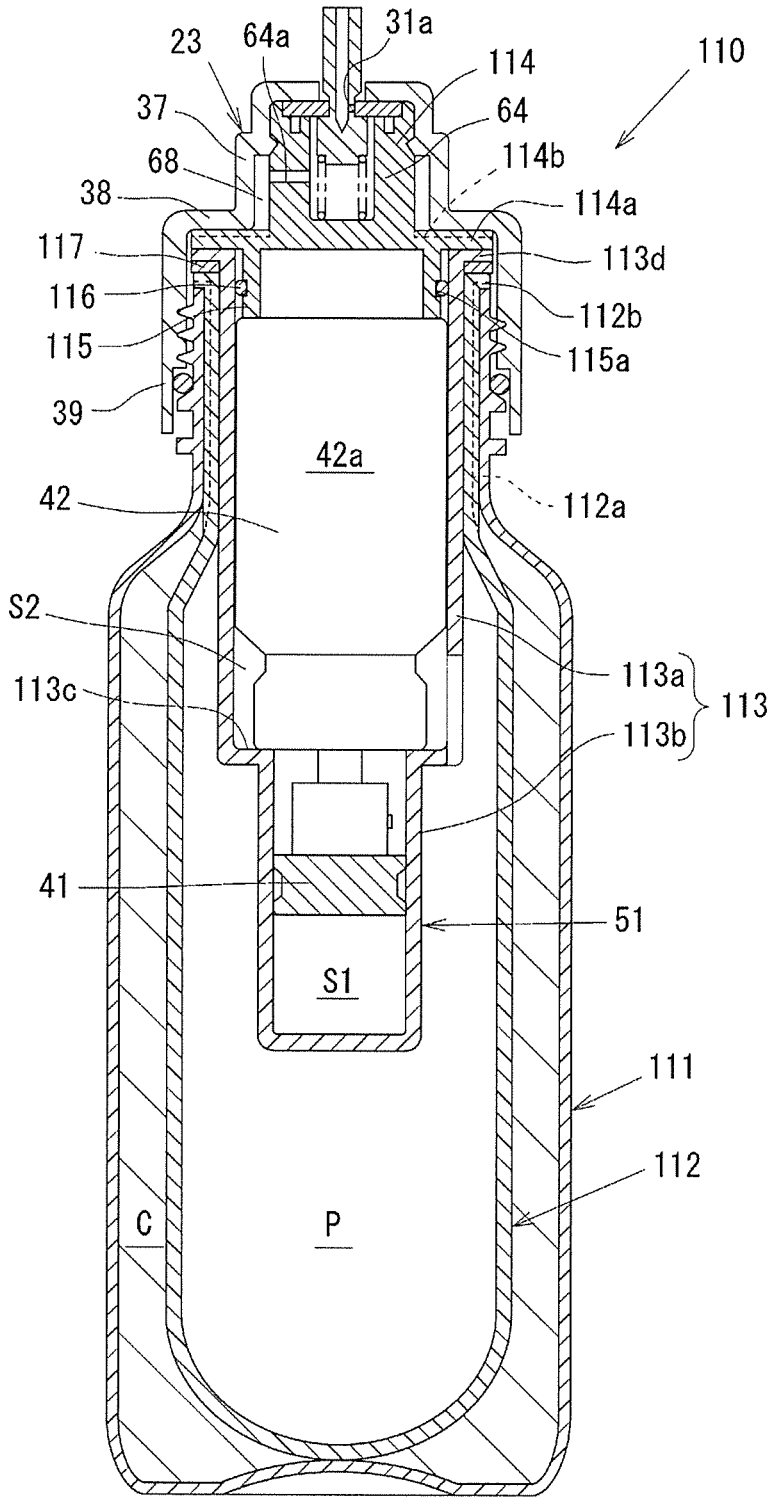
FIG. 13 is a cross-sectional view showing still yet another embodiment of a discharge container according to the present invention.

The discharge container 110 shown in FIG. 13 is a double container and is provided with an outer container 111 and an inner container 112 accommodated in the outer container 111. In this discharge container 110, contents C are filled between the outer container 111 and the inner container 112, and a pressurizing agent P is filled in the inner container 112.

Like the aforementioned discharge container, the outer container 111 has pressure resistance capable of withstanding pressure of 0.1 to 0.3 MPa. As a material, in addition to a synthetic resin, such as, e.g., PET, PE, and PP, metal may be used. The inner container 112 has flexibility that changes its shape in such a way as to expand due to the pressure of the pressurizing agent P. As a material, it is preferable to use a thermoplastic resin, such as, PET, PE, and PP. The inner diameter of the neck portion of the outer container 111 and the outer diameter of the neck portion of the inner container 112 are set to be substantially equal, so that both the neck portions are in close contact with each other. Therefore, in order to secure a passage for communicating the space (contents storage chamber) between the outer container 111 and the inner container 112 and the outside, a vertical groove 112*a* is provided on the outer peripheral surface side of the neck portion of the inner container 112, so that a vertical passage is formed between the outer container 111 and the inner container 12. A flange portion 112*b* for preventing excessive entry thereof into the outer container 111 is provided at the upper end of the neck portion of the inner container 112. The vertical groove 112*a* extends to the lower surface of this flange portion 112*b*.

At the opening of the inner container 112, a container holder 113 is attached. The container holder 113 has a bottomed cylindrical shape and is divided into an accommodation portion 113*a* accommodating a gas container 42 and a cylinder portion 113*b* accommodating a piston 41. The cylinder portion 113*b* has a diameter smaller than the diameter of the accommodation portion 113*a* and that of the container body 42*a*, and the container body 42*a* comes into contact with the step 113*c* provided between the cylinder portion 113*b* and the accommodation portion 113*a*, so that the downward movement thereof is restricted. Therefore, the press amount of the gas container 42 is always stabilized, which can improve the accuracy of the pressure adjustment. Further, a concave groove 115*a* is formed on the outer peripheral surface of the lower cylinder 115 of the valve holder 114 and an O-ring 116 is provided in the concave groove 115*a*. Therefore, at the stage of pushing the gas container 42 downward by the valve holder 114, it is possible to seal between the outer peripheral surface of the lower cylinder 115 of the valve holder 114 and the inner peripheral surface of the container holder 113. Thus, it is possible to suppress leakage of the pressurizing agent P. A seal between the inner container 112 and the container holder 113 is formed by a gasket 117 provided between the upper surface of the flange portion 112*b* of the inner container 112 and the lower surface of the flange portion 113*d* of the container holder 113.

In the discharge product in which contents C are filled in the discharge container 110 of the aforementioned configuration, the contents C are discharged to the outside in such a way as to be driven by the inflating inner container 112. The contents C enter to the inside of the housing portion 64 via a vertical passage between the inner surface of the neck portion of the outer container 111 and the outer surface of the neck portion of the inner container 112, between the lower surface of the flange portion 112*b* of the inner container 112 and the upper surface of the neck portion of the outer container 111, between the inner peripheral surface of the lower cylindrical portion 39 of the cap 23 and the outer side surface of the flange portion 112*b* of the inner container 112, between the inner peripheral surface of the lower cylindrical portion 39 of the cap 23 and the outer side surface of the gasket 117, between the inner peripheral surface of the lower cylindrical portion 39 of the cap 23 and the outer side surface of the flange portion 114*a* of the valve holder 114, a lateral passage formed between the concave groove 114*b* provided on the upper surface of the flange portion 114*a* of the valve holder 114 and the lower surface of the ring portion 38 of the cap 23, a cylindrical space 68 formed between the inner peripheral surface of the upper cylindrical portion 37 of the cap 23 and the outer peripheral surface of the housing portion 64 of the valve holder 114, and the lateral hole 64*a*, and then is discharged to the outside (discharge member) from the stem hole 31*a*.

Normally, as the inner container 112 bulges, the pressure drops accordingly. In this discharge container 110, since the pressure regulating mechanism 51 is provided in the inner container 112, the pressure inside the inner container 112 can be kept constant. For this reason, the ejection momentum does not decline in the middle of the ejection, and contents can be stably discharged till the end.

Although the various discharge containers according to the present invention are described above, these discharge containers are equipped with the pressure regulating mechanisms 13 and 51. Therefore, the pressure in the container 11, 61, 85, and 91 can be kept to low pressure (for example, 0.1 to 0.3 MPa). Further, this pressure can be maintained even if the contents C are discharged. Therefore, it is possible to use a container thinner than the conventional one (low pressure resistance).

Further, by turning the cap 23, 62, and 88, the valve assembly 12 can be removed easily. Therefore, when either one (or both) of the pressurizing agent P and the contents C is discharged completely, it is possible to remove the valve assembly 12 and the pressure regulating mechanism 13 and 51, exchange the gas container 42, and reuse the container by refilling contents therein.

Figure 14:
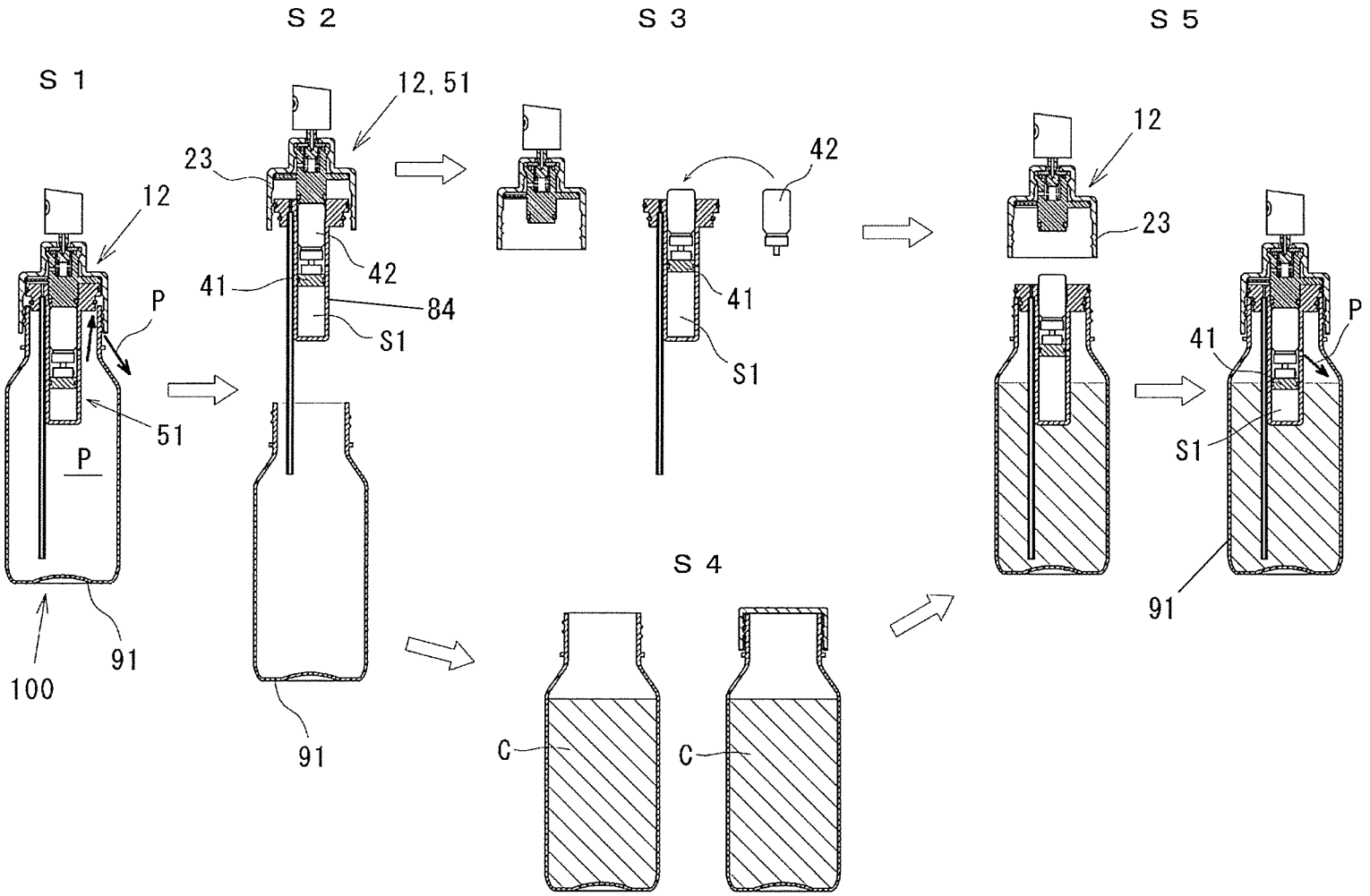
FIG. 14 is a view showing a process of reusing the discharge container shown in FIG. 12.

FIG. 14 shows steps of reusing the discharge container 100 shown in FIG. 12. In reusing, initially, it is necessary to remove the valve assembly 12 from the container 91. At that time, if the pressurizing agent P remains in the container, the entire pressure assembly is raised by the pressure, so that a gap is naturally formed between the pressure assembly and the container assembly. As a result, the pressurizing agent P remained in the container will be discharged to the outside from the gap (S1 in FIG. 14: pressurizing agent discharge step). At this time, since the screw threads of the cap 23 maintain the state of being screwed with the screw threads of the container 91, the valve assembly 12 never flies out due to the pressure of the pressurizing agent P. In cases where the pressurizing agent P remains in the gas container 42, when the pressurizing agent P is discharged and the pressure in the container 91 drops, the pressure regulating mechanism 13 and 51 is normally operated and the pressurizing agent P is supplied into the container from the gas container 42. However, when the cap 23 is loosened, the pressing on the piston 41 is weakened and the pressure of the pressure regulating chamber S1 drops accordingly (the pressure regulating mechanism is released). For this reason, in a state in which the pressurizing agent P is remained in the gas container 42, the valve assembly 12 and the pressure regulating mechanism 51 can be removed from the container (S2 in FIG. 14: removal step).

In cases where an insufficient amount of the pressurizing agent remains in the gas container 42, the gas container 42 is exchanged (S3 in FIG. 14: Gas container exchange step). At this time, like the discharge container shown in FIG. 11 and FIG. 12, when the gas container 42 is positioned at the upper portion of the piston 41, the gas container is lifted up by the pressure of the pressure regulating chamber S1, so that the replacement can be performed easily.

In cases where a sufficient amount of the pressurizing agent remains in the gas container 42, the step of S3 may be omitted.

S4 is a step of preparing a container filled with contents. Filling of the contents C into the container 91 is performed as follows. A user separately purchases a refill container in which contents are filled in a pouch, etc., and fills the contents in the emptied container. Note that a manufacturer may collect the emptied container and fill the contents (in a container with a lid shown in the figure). Further, in cases where a user recycles the container as a resource waste, the container can be reduce in volume by crushing the container, so it is not bulky for storage at home and the collection efficiency is good.

When the valve assembly 12 is attached to the container, the piston 41 is pushed into the cylinder portion 84 and the pressure in the pressure regulating chamber S1 rises. Then, the pressurizing agent P is supplied from the gas container 42 into the container 91 so that the contents C can be discharged (S5 in FIG. 14: Pressurizing agent filling step). At this time, like the discharge containers shown in FIGS. 9 to 13, when an O-ring is placed on the outer peripheral surface of the valve holder (or container holder), the container will be blocked prior to pushing the gas container 42 by the cap 23, so the pressurizing agent P will not leak to the outside. Note that the reuse method is not limited to the discharge container shown in FIG. 12, and can be similarly applied to other discharge containers.

DESCRIPTION OF REFERENCE SYMBOLS

C Contents
P Pressurizing agent
S1 Upper space (pressure regulating chamber),
S2 Lower space (open chamber)
10, 10*a* Discharge container
Bottle (container)
11*a* Screw thread
11*b* Seal holding portion
11*b*1 Outer cylindrical portion
11*b*2 Annular projection
11*c* annular step portion

12 Valve assembly
13 Pressure regulating mechanism
16 Sealing material
17 Gasket
21 Valve holder
22 Valve mechanism
23 Cap
26 Housing
  26*a* Communication hole
  26*b* Connecting cylinder
  26*c* Rubber support portion
  26*d* Recess
27 Flange portion
  27*a* Seal holding wall
31 Stem
  31*a* Stem hole
32 Stem rubber
33 Spring
36 Cover portion
  36*a* Center hole
37 Upper cylindrical portion
  37*a* Engaging protrusion
38 Ring portion
39 Lower cylindrical portion
  39*a* Screw thread
  39*b* Inner cylindrical portion
40 Cylinder member
41 Piston
42 Aerosol container (gas container)
  42*a* Pressure-resistant container
    42*a*1 Neck portion
  42*b* Aerosol valve
    42*b*1 Stem
  42*c* Push button
    42*c*1 Discharge port
  42*d* Cylinder engaging portion
45 Valve holder
46 Cylinder portion
  46*a* Slit
  46*b* Holding claw
47 Connecting portion
  47*a* First connecting hole (connecting groove)
  47*b* Second connecting hole (communication passage)
  47*c* Communication passage
48 Concentrate introduction member
  48*a* Adapter
  48*b* Tube
49 Introduction member connecting portion
50 Discharge container
51 Pressure regulating mechanism
55 Container holder
  55*a* Holder body
  55*b* Flange portion
  55*c* Bottom portion
  55*d* Slit
  55*e* Positioning rib
  55*f* Insertion hole
60 Discharge container
61 Container
  61*a* Rolled portion
  61*b* cylindrical portion
  61*c* Screw thread
62 Cap
  62*a* Upper cylindrical portion
60 Valve holder
64 Housing portion
  64*a* Lateral hole
65 Cylinder portion
66 Flange portion
  66*a* Through-hole
67 Introduction member connecting portion
68 Cylindrical space
70 Discharge container
71 Annular wall
  71*a* Concave groove
72 O-ring
80 Discharge container
81 Valve holder
82 Housing
83 Container holder
84 Cylinder portion
  84*a* Communication hole
85 Container
88 Cap
90 Discharge container
91 Bottle
92 Sealing material
100 Discharge container
101 Flange portion
  101*a*, 101*b* Groove
102 Concave groove
103 O-ring
110 Discharge container
111 Outer container
112 Inner container
  112*a* Vertical groove
  112*b* Flange portion
113 Container holder
  113*a* Accommodation portion
  113*b* Cylinder portion
  113*c* Step
  113*d* Flange portion
114 Valve holder
  114*a* Flange portion
  114*b* Concave groove
115 Lower cylinder
  115*a* Concave groove
116 O-ring
117 Gasket

The invention claimed is:

1. A discharge container comprising:

a container;

a valve assembly configured to close the container, the valve assembly including a valve mechanism; and a pressure regulating mechanism attached to a lower portion of the valve assembly, the pressure regulating mechanism being configured to raise internal pressure of the container to predetermined pressure when the internal pressure drops, wherein the pressure regulating mechanism includes a cylinder portion provided below the valve assembly, a piston vertically slidably inserted in the cylinder portion to divide the cylinder portion into a pressure regulating chamber and an open chamber opened in the container, and a gas container filled with a pressurizing agent and communicated with an inside of the container in conjunction with a vertical movement of the piston, when a force received by internal pressure of the container is smaller than a force received from the pressure regulating chamber, the piston moves to open the gas container so that a capacity of the pressure regulating chamber becomes larger than a predetermined capacity to supply the pressurizing agent into the container, and when the force received by the internal pressure of the container is the same or larger than the force received from the pressure regulating chamber, the piston moves to close the gas container so that the capacity of the pressure regulating chamber becomes the same or smaller than the predetermined capacity, wherein the gas container is supported in a container, and wherein the gas container is supported by a bottom portion of the container.

2. The discharge container as recited in claim 1, wherein the container and the valve assembly are detachably connected.

3. The discharge container as recited in claim 1, wherein the cylinder portion is attached to a lower portion of the valve assembly.

4. The discharge container as recited in claim 1, wherein the gas container is vertically movable in the cylinder portion.

5. The discharge container as recited in claim 1, wherein the cylinder portion includes a holding means configured to hold the gas container.

6. A method of reusing a discharge container as recited in claim 1, comprising:

a step of detaching the valve assembly and the pressure regulating mechanism from the container;

a step of attaching the valve assembly and the pressure regulating mechanism to the container filled with contents; and a step of operating the pressure regulating mechanism to fill the pressurizing agent in the container.

7. The method of reusing a discharge container as recited in claim 6, wherein an inside of the pressure regulating chamber is decompressed and then the valve assembly and the pressure regulating mechanism are detached from the container.

8. The method of reusing a discharge container as recited in claim 6, wherein after replacing the gas container, the valve assembly and the pressure regulating mechanism are attached to the container filled with contents.

9. The method of reusing a discharge container as recited in claim 6, wherein the pressure regulating mechanism is actuated in accordance with a press by the cap of the valve assembly.

10. The discharge container as recited in claim 1, wherein the valve assembly includes a cap for actuating the pressure regulating mechanism by pressing.

11. A discharge container comprising:

a container;

a valve assembly configured to close the container, the valve assembly including a valve mechanism; and a pressure regulating mechanism attached to a lower portion of the valve assembly, the pressure regulating mechanism being configured to raise internal pressure of the container to predetermined pressure when the internal pressure drops, wherein the pressure regulating mechanism includes a cylinder portion provided below the valve assembly, a piston vertically slidably inserted in the cylinder portion to divide the cylinder portion into a pressure regulating chamber and an open chamber opened in the container, and a gas container filled with a pressurizing agent and communicated with an inside of the container in conjunction with a vertical movement of the piston, when a force received by internal pressure of the container is smaller than a force received from the pressure regulating chamber, the piston moves to open the gas container so that a capacity of the pressure regulating chamber becomes larger than a predetermined capacity to supply the pressurizing agent into the container, and when the force received by the internal pressure of the container is the same or larger than the force received from the pressure regulating chamber, the piston moves to close the gas container so that the capacity of the pressure regulating chamber becomes the same or smaller than the predetermined capacity, wherein the gas container is vertically movable in the cylinder portion.

12. The discharge container as recited in claim 11, wherein the container and the valve assembly are detachably connected.

13. The discharge container as recited in claim 11, wherein the cylinder portion is attached to a lower portion of the valve assembly.

14. The discharge container as recited in claim 11, wherein the gas container is supported in a container.

15. The discharge container as recited in claim 14, wherein the gas container is supported by a bottom portion of the container.

16. The discharge container as recited in claim 11, wherein the pressure regulating mechanism includes a container holder accommodated in the container so as to be suspended from an opening of the container, a communication hole for communicating the inside of the container holder with the inside of the container is formed in the container holder, and the gas container is supported by the container holder.

17. The discharge container as recited in claim 11, wherein the cylinder portion includes a holding means configured to hold the gas container.

18. The discharge container as recited in claim 16, wherein the container holder also serves as the cylinder portion.

19. The discharge container as recited in claim 16, wherein the container holder includes the cylinder portion with a bottomed cylindrical shape, a pressure regulating chamber is formed between a bottom portion of the cylinder portion and the piston, and the gas container is accommodated above the pressure regulating chamber.

20. A method of reusing a discharge container as recited in claim 11, comprising:

a step of detaching the valve assembly and the pressure regulating mechanism from the container;

a step of attaching the valve assembly and the pressure regulating mechanism to the container filled with contents; and a step of operating the pressure regulating mechanism to fill the pressurizing agent in the container.

21. The method of reusing a discharge container as recited in claim 20, wherein an inside of the pressure regulating chamber is decompressed and then the valve assembly and the pressure regulating mechanism are detached from the container.

22. The method of reusing a discharge container as recited in claim 20, wherein after replacing the gas container, the valve assembly and the pressure regulating mechanism are attached to the container filled with contents.

23. The method of reusing a discharge container as recited in claim 20, wherein the pressure regulating mechanism is actuated in accordance with a press by the cap of the valve assembly.

24. The discharge container as recited in claim 11, wherein the valve assembly includes a cap for actuating the pressure regulating mechanism by pressing.

25. A discharge container comprising:

a container;

a valve assembly configured to close the container, the valve assembly including a valve mechanism; and a pressure regulating mechanism attached to a lower portion of the valve assembly, the pressure regulating mechanism being configured to raise internal pressure of the container to predetermined pressure when the internal pressure drops, wherein the pressure regulating mechanism includes a cylinder portion provided below the valve assembly, a piston vertically slidably inserted in the cylinder portion to divide the cylinder portion into a pressure regulating chamber and an open chamber opened in the container, and a gas container filled with a pressurizing agent and communicated with an inside of the container in conjunction with a vertical movement of the piston, when a force received by internal pressure of the container is smaller than a force received from the pressure regulating chamber, the piston moves to open the gas container so that a capacity of the pressure regulating chamber becomes larger than a predetermined capacity to supply the pressurizing agent into the container, and when the force received by the internal pressure of the container is the same or larger than the force received from the pressure regulating chamber, the piston moves to close the gas container so that the capacity of the pressure regulating chamber becomes the same or smaller than the predetermined capacity, wherein the pressure regulating mechanism includes a container holder with a bottomed cylindrical shape accommodated in the container so as to be suspended from an opening of the container, wherein a communication hole for communicating the inside of the container holder with the inside of the container is formed in the container holder, and wherein the entire gas container is accommodated in the container holder.

26. The discharge container as recited in claim 25, wherein the container and the valve assembly are detachably connected.

27. The discharge container as recited in claim 25, wherein the cylinder portion is attached to a lower portion of the valve assembly.

28. The discharge container as recited in claim 25, wherein the gas container is vertically movable in the cylinder portion.

29. The discharge container as recited in claim 25, wherein the cylinder portion includes a holding means configured to hold the gas container.

30. The discharge container as recited in claim 25, wherein the container holder also serves as the cylinder portion.

31. The discharge container as recited in claim 25, wherein the container holder includes the cylinder portion with a bottomed cylindrical shape, a pressure regulating chamber is formed between a bottom portion of the cylinder portion and the piston, and the gas container is accommodated above the pressure regulating chamber.

32. A method of reusing a discharge container as recited in claim 25, comprising:

a step of detaching the valve assembly and the pressure regulating mechanism from the container;

a step of attaching the valve assembly and the pressure regulating mechanism to the container filled with contents; and a step of operating the pressure regulating mechanism to fill the pressurizing agent in the container.

33. The method of reusing a discharge container as recited in claim 32, wherein an inside of the pressure regulating chamber is decompressed and then the valve assembly and the pressure regulating mechanism are detached from the container.

34. The method of reusing a discharge container as recited in claim 32, wherein after replacing the gas container, the valve assembly and the pressure regulating mechanism are attached to the container filled with contents.

35. The method of reusing a discharge container as recited in claim 32, wherein the pressure regulating mechanism is actuated in accordance with a press by the cap of the valve assembly.

36. The discharge container as recited in claim 25, wherein the valve assembly includes a cap for actuating the pressure regulating mechanism by pressing.

37. The discharge container as recited in claim 25, wherein the container holder includes a cylinder portion with a bottomed cylindrical shape accommodating a piston and an accommodation portion accommodating a gas container, a step provided between the cylinder portion and the accommodation portion.

* * * * *